US011492935B2

(12) United States Patent
Lentini

(10) Patent No.: US 11,492,935 B2
(45) **Date of Patent: *Nov. 8, 2022**

(54) OIL CHANGE APPARATUS AND RELATED METHODS

(71) Applicant: JDL Tech USA LLC, Newton Highlands, MA (US)

(72) Inventor: Joseph Lentini, Tustin, CA (US)

(73) Assignee: JDL Tech USA LLC, Newton Highlands, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/572,467

(22) Filed: Jan. 10, 2022

(65) Prior Publication Data

US 2022/0154606 A1 May 19, 2022

Related U.S. Application Data

(63) Continuation of application No. 16/927,839, filed on Jul. 13, 2020, now Pat. No. 11,255,237.

(60) Provisional application No. 62/874,271, filed on Jul. 15, 2019.

(51) Int. Cl.
*F01M 11/04* (2006.01)
*F04B 23/02* (2006.01)

(52) U.S. Cl.
CPC ..... *F01M 11/045* (2013.01); *F04B 23/02* (2013.01)

(58) Field of Classification Search
CPC .. F01M 11/04; F01M 11/045; F01M 11/0458; F16N 31/00; F04B 23/02
See application file for complete search history.

(56) References Cited

U.S. PATENT DOCUMENTS 2,425,848 A * 8/1947 Vawter ..... B01D 25/00 134/107
2,552,749 A * 5/1951 Tabet ..... F01M 11/045 222/25
2,603,312 A 7/1952 Tabet
3,095,062 A 6/1963 Neely
4,095,673 A 6/1978 Takeuchi
4,193,487 A * 3/1980 Takeuchi ..... G07F 13/00 194/241
5,372,219 A 12/1994 Peralta
6,123,174 A 9/2000 Elkin et al.
(Continued)

OTHER PUBLICATIONS

Non-Final Office Action on co-pending (U.S. Appl. No. 16/927,839) dated Jul. 19, 2021.

(Continued)

*Primary Examiner* — Minh Truong
(74) *Attorney, Agent, or Firm* — KOS IP Law LLP

(57) ABSTRACT

An oil change machine or apparatus for removing used oil from an engine has flow lines for removing oil directly from the engine, which can be an automobile engine or a boat engine. The oil change machine can be configured to empty used oil to a designated waste oil bin. The oil change apparatus or machine can be located at a shop, can be portable and maneuverable from locations to locations, or be mounted on a service vehicle for on-site use, such as to perform oil change away from an oil lube center. The oil change machine can have adaptors for use with various engine models and can include an onboard offloading tank, in addition to a service holding tank, for performing multiple oil changes.

23 Claims, 16 Drawing Sheets

(56) References Cited

U.S. PATENT DOCUMENTS

| | | | | |
|---|---|---|---|---|
| 6,378,657 | B2 | 4/2002 | Viken | |
| 6,772,802 | B2 | 8/2004 | Few | |
| 6,830,083 | B1 | 12/2004 | Hollub et al. | |
| 9,260,988 | B2 | 2/2016 | Lin | |
| 10,463,197 | B2 | 11/2019 | Coco | |
| 2002/0084144 | A1* | 7/2002 | Liao | F01M 11/0458 184/1.5 |
| 2004/0089371 | A1 | 5/2004 | Few | |
| 2004/0159495 | A1 | 8/2004 | Erwin et al. | |
| 2013/0287593 | A1 | 10/2013 | Erwin et al. | |
| 2014/0309794 | A1 | 10/2014 | Apostolides | |
| 2016/0236657 | A1* | 8/2016 | Erwin | B67D 7/845 |

OTHER PUBLICATIONS

Final Office Action on co-pending (U.S. Appl. No. 16/927,839) dated Nov. 1, 2021.

* cited by examiner 138
136
100
130
106
134
132
140a
140b
102
122
168
158
156
154
166
162
162
164
114
170
104
172
108
110
120
116
144
144
146
146
124

STEP #1

STEP #2

STEP #3

OIL CHANGE APPARATUS AND RELATED METHODS

FIELD OF ART

The present disclosure is generally directed to an apparatus for changing engine oil and more particularly to an apparatus for removing used lubricant oil from an engine using a vacuum source and related methods.

BACKGROUND

Quick lube oil change centers are widely available to provide oil change services to vehicle engines and to quickly fill the engines with new oil. This process may take about 15 to 25 minutes per vehicle depending on the vehicle type. In a typical quick lube store or center, a way for a technician to remove used oil is from below the vehicle and working from a space known as the pit. The technician removes the engine shroud or splash pan, which covers and protects the oil pan and the bottom of the engine from debris or from contact with the ground. These shrouds or splash pan may use anywhere from four (4) screws to eighteen (18) screws. In some cases, the splash pan or shroud also covers the oil pan plug. Even where there is no shroud or splash pan, the technician still has to remove the oil pan plug to drain the oil in a typical oil change process.

Before the technician removes the oil pan plug, after removing the shroud or splash pan, the technician usually removes the dipstick from the engine and check the oil level as many times the engine may be low of oil. Once the technician has read the specifications of the vehicle oil requirements (usually in quartz), the technician below in the pit will remove the oil pan plug and let the oil drain out. This process can take several minutes depending on the capacity of oil in the engine. The oil plug is then reinstalled and the shroud or splash guard mounted.

Based on the foregoing processes, the quick lube shop owner may be subjected to a few liability issues. Because technicians at these shops will often try to do the oil change services as quickly as possible, the technicians may inadvertently cause the heads of the screws to accidentally snap off during removal, especially if they are corroded or rusted. When replacing the screws, over-tightening has been known to strip the oil pan screws and/or plugs, causing oil leak. When this occurs, the quick lube shop owner needs to buy a new oil pan and provide the warranty repair, or the customer may need to take his or her car to a dealership and have the broken screws removed from the lower casing of the engine so the shroud can be put back into place.

SUMMARY

An oil change machine or apparatus for removing used oil from an engine has flow lines for removing oil directly from the engine, which can be an automobile engine or a boat engine, such as an inboard engine. The oil change machine can remove oil using a suction or a vacuum to pull the oil directly from the engine, as opposed to draining the oil via the oil pan plug. Because different engines can have different requirements, adapters, called draw hose assemblies, may be used to enable connection to different ports for suctioning the used oil.

Once used oil is collected in a service holding tank, the used oil can be transferred directly from the service holding tank to a designated waste oil bin or transferred first to an offloading tank to hold discrete quantities of used oil removed from multiple engines. The offloading tank saves time that the technicians otherwise may have to spend to dispose the used oil to a designated waste bin after every oil service.

The oil change machine can use a pump, which can operate using compressed air or electricity, to remove used oil from an engine. A separate process can supply new oil to replace or replenish the removed used oil. Thus, the oil change machine of the present invention is understood to be usable in an oil change process to change used oil with new oil.

The oil change apparatus or machine can be located at a shop, can be portable and maneuverable from locations to locations, or be mounted on a service vehicle for on-site use, such as to perform oil change away from an oil lube center. The oil change machine can have adaptors for use with various engine models and can include an onboard offloading tank, in addition to a service holding tank, for performing multiple oil changes. In an example, a suction line is in fluid communication with an engine, such as to the used oil located proximate a dipstick port of an engine, and to an inlet of a pump such that vacuum generated by the pump can draw up oil through the suction line and into the pump.

Aspects of the invention include an oil change machine comprising a pump for providing the vacuum source used to suction used oil from an engine. The oil change machine can include a suction line having a fitting with a hose and wherein the hose is configured to suction oil directly from an engine. The used oil can be suctioned by placing the hose directly into the engine compartment, such as into a dipstick port or tube of an engine.

The oil change machine can have a pump inlet and a pump discharge, the pump being operable using pressurized air or electrical power; a first multi-port valve having a first control switch connected to the pump inlet; a second multi-port valve connected to the pump discharge; a suction line located upstream of the first multi-port valve and configured to suction used oil directly from an engine; and a flow line connected to the second multi-port valve and to a service holding tank.

The oil change machine can comprise a housing having a main body and a top section, and wherein the pump and the service holding tank can be located at least partially inside the main body.

Two or more wheels for supporting and moving the housing can be provided or the housing can be located on a service vehicle, such as a service truck or a service van for moving the oil change machine to a remote, on-site, location for servicing an engine.

The oil change machine can further comprise an offloading tank, and wherein a second flow line can connect the offloading tank to the second multi-port valve.

Aspects of the invention further include an oil change machine comprising a pump having a pump inlet and a pump discharge, the pump being operable using pressurized air or electrical power; a first multi-port valve having a first control switch connected to the pump inlet; a second multi-port valve connected to the pump discharge; a suction line located upstream of the first multi-port valve and configured to suction used oil directly from an engine; a flow line connected to the first multi-port valve and to a service holding tank; and wherein the oil change machine is located on a service vehicle.

Yet a further aspect of the invention includes an oil change machine comprising a pump having a pump inlet and a pump discharge, the pump being operable using pressurized air or electrical power; a first multi-port valve having a first control switch connected to the pump inlet; a second multi-port valve connected to the pump discharge; a suction line located upstream of the first multi-port valve and configured to suction used oil directly from an engine, said suction line comprising a connection fitting; and at least two draw hose assemblies, which include a first draw hose assembly and a second draw hose assembly, each draw hose assembly comprising a mating fitting for coupling to the connection fitting and a hose extending from the mating fitting.

The hose of the first draw hose assembly can have a first inside bore diameter and the hose of the second draw hose assembly can have a second inside bore diameter, and wherein the second inside bore diameter can be larger or smaller than the first inside bore diameter.

A still yet further aspect of the invention is an oil change machine comprising a housing having at least two openings, including a first opening and a second opening; a pump having a pump inlet and a pump discharge located inside the housing, the pump being operable using pressurized air or electrical power; a first multi-port valve having a first control switch connected to the pump inlet; a second multi-port valve connected to the pump discharge; a suction line located upstream of the first multi-port valve and configured to suction used oil directly from an engine; a service holding tank for receiving used oil discharged from the pump partially projecting into the first opening; and an offloading tank located inside the housing and having a flow line connected to a port of the offloading tank and a port of the second multi-port valve.

Aspects of the invention further include a method for removing used oil from an engine comprising placing a hose having a first inside bore diameter into a dipstick tube and powering a pump to draw the used oil through the hose and into an inlet of the pump.

The method can comprise discharging the used oil into a service holding tank located at least partially inside a housing, which also has the pump located therein.

The method can further comprise replacing the hose with a second hose having a second inside bore diameter, and wherein the second inside bore diameter can be larger than or smaller than the first inside bore diameter.

Yet another aspect of the invention includes a method for removing used oil from an engine comprising turning on an air driven pump to suction used oil from an engine; emptying the used oil into a service holding tank; and moving the used oil from the service holding tank into an offloading tank.

The pump and the offloading tank can both be located inside an interior of a housing.

The service holding tank can be located at least partially inside the interior of the housing.

Another method in accordance with aspects of the invention can include a method of making an oil change machine comprising providing a housing with an interior and at least one opening; placing a pump having a pump inlet and a pump discharge into the interior of the housing; wherein the pump is operable by air pressure or electricity; connecting a first multi-port valve having a first control switch to the pump inlet; connecting a second multi-port valve to the pump discharge; connecting a suction line upstream of the first multi-port valve, said suction line configured to suction used oil directly from an engine; placing a service holding tank at least partially into the interior of the housing for holding used oil discharged from the pump.

The method can comprise the step of supplying DC power to electrical components mounted on or inside the housing.

The DC power can be supplied using a number of sources or options, including using household power with a converter, using a lithium ion rechargeable battery, using rechargeable lead acid battery, or using an inline turbine generator.

Aspects of the invention can include wireless communications between the oil change machine and a smart electronic device, such as a smartphone, a tablet, or a computer.

Methods of using and of making the oil change assembly or machine disclosed herein and components thereof are within the scope of the present disclosure.

BRIEF DESCRIPTION OF THE DRAWINGS

These and other features and advantages of the present devices, systems, and methods will become appreciated as the same becomes better understood with reference to the specification, claims and appended drawings wherein:

DETAILED DESCRIPTION

The detailed description set forth below in connection with the appended drawings is intended as a description of the presently preferred embodiments of change machines or apparatuses and components provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Figure 1:
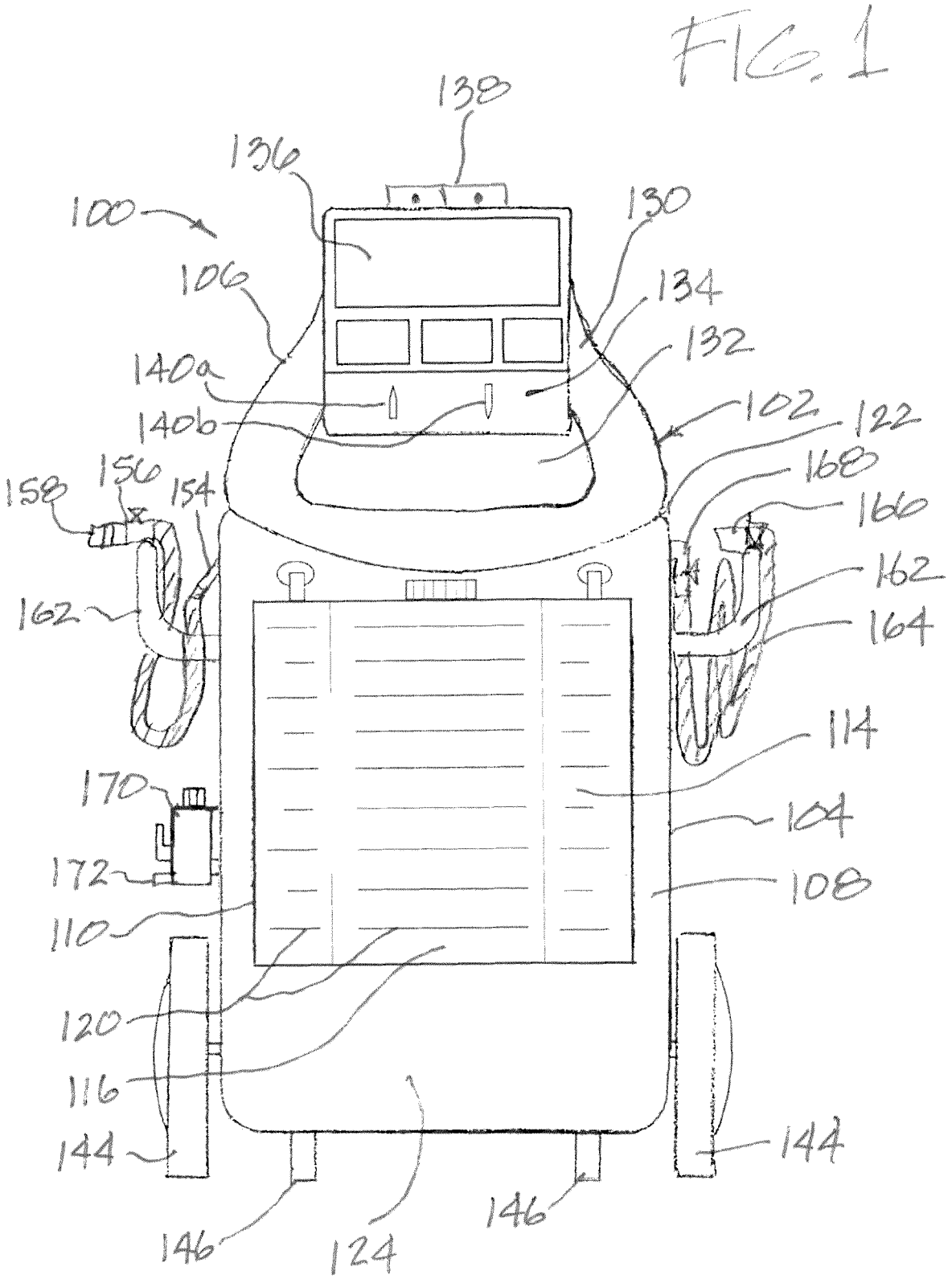
FIG. 1 is a schematic front elevation view of an oil change machine provided in accordance with aspects of the invention.

With reference now to FIG. 1, an oil change machine or apparatus provided in accordance with aspects of the invention is shown, which is generally designated as element 100. In an embodiment, the oil change machine 100 has a housing 102 comprising a main body section or main housing section 104 and a top housing section or top section 106. Each of the two sections 104, 106 can have one or more panels or compartments combined to form the respective section. In an example, the main body section 104 comprises a primary shell 108 that is sized and shaped to hold, contain, or accommodate a plurality of oil change machine components. For example and as further discussed below, the primary shell 108 has an interior and is provided with an opening 110 for holding or accommodating a service holding tank 114, which has a shell or a body 116 with an interior for holding used oil that has been removed from an engine, such as an automobile engine or a boat engine. The service holding tank can be positioned at least in part inside the interior of the main body section and project at least partially through the front opening 110.

The shell 116 of the holding tank 114 can be made from a transparent or semi-transparent plastic material to enable viewing the oil level inside the interior of the holding tank 114. Thus, when six (6) quartz of oil, as an example, has been removed from an engine and discharged into the holding tank 114, a technician can visually ascertain the presence of the used oil inside the holding tank 114. The holding tank 114 can include markers or scales 120, which can be calibrated to measure the volume of oil contained in the interior of the shell 116. In other words, each line of the scale 120 can represent a quart, a half of a quart, or a quarter of quart, etc.

In an example, the main body section 104 of the housing is made from a hard plastic material using a blow molding process, optionally with any number of colors such as black, green, blue, etc. The main body section 104 can be provided with a front opening 110, as previously described, and a top opening 122. The front opening 110 can be sized and shaped to receive the service holding tank 114 so that the front contour of the service holding tank is generally flat or flush with the front surface 124 of the primary shell 108. In other examples, the front of the service tank 114 can project outwardly of a plane defined by the front opening 110 to allow room in the interior of the main body 104 for accommodating other components.

The top opening 122 is configured to mate with the top section 106, which encloses the top opening 122 and provides a top console for a workspace and/or for mounting various controls. The combination top opening 122 and front opening 122 enable a technician to assemble the various components to the main body in assembling the oil change machine 100, as further discussed below. In an example, the top section 106 is hinged to a back section of the main body 104, such as at or near the perimeter of the upper or top opening 122. This hinge arrangement allows the top section 106 to flip upwardly from the front, near the service holding tank 114, to allow access to the interior of the main body 104, such as for performing maintenance, for repairs, for upgrades, for adding accessories or features, etc.

As shown, the top console 130 includes a recess space 132, which can be molded into the panel, a control panel 134, an information panel 136, and an electronic or electrical feedback indicator 138. The recess space 132 can be used by a technician to temporarily hold loose parts, paperwork, or otherwise use as a workspace. In an example, the control panel 134 comprises a wall surface comprising two or more handles, or switches 140*a*, 140*b*. In other examples, there can be only one switch or handle or more than two handles or switches. As further discussed below, the control switches can be electronic switches and can toggle to cause an action, such as to initiate a pump or an actuator, to close or open a valve, to turn on an alarm, to initialize the system, to display information on a screen, etc. In a particular example, the two switches 140*a*, 140*b* are two valve handles for controlling the positions of valve stems of the two different multi-port valves. By changing the positions of the two switches, or the positions of the two valve stems, a suction line connected to the onboard pump and the discharge line flowing from the pump can be routed to flow to or to flow from different locations, as further discussed below.

The information panel 136 can comprise a surface having information indicia, such as product information, instructions, a readout display, etc. The information can be used to assist the technician with operating the oil change machine 100. For example, the information can present instructions on how to use the machine 100 in a stepwise format to show the technician the various steps for activating and operating the oil change machine. In some examples, an electronic display is provided to provide information for operating the oil change machine. For example, the electronic display can show the elapsed time or time duration from when the project or job started, can show the volume of oil removed from an engine, can show the number of services since a start time or since the machine was last reset, etc. In a particular example, an adhesive decal with printed information or instructions can be used and can adhere to a surface of the top console to function as an information panel 136.

The electronic feedback indicator 138 can include one or more lights, such as one or more light emitting diodes (LEDs) for providing feedback or indication regarding the status or health of the oil change machine 100. In an example, when the machine is first energized with a power source, a green light indicator will light up at the electronic feedback indicator 138. The light can remain on for the time duration that the machine 100 is energized. In some example, a second light can come on as an alert signal, optionally with an audible alarm. For example, a level switch can be provided in the service holding tank 114, in the offloading tank 182 (FIG. 3) located inside the main body, or in both the holding tank 114 and the offloading tank 182. When the tank level in the holding tank 114, the offloading tank 182, or both tanks reach a set level, or different levels for the two different tanks, the second light can light up, which can have a different color, such as red.

The second light can indicate that it is time to empty the offloading tank 182. In an example, each tank can be provided with an electronic level gauge or electronic tank gauge with an electronic output that can be used to trigger the second light. In a particular embodiment, only the offloading tank 182 (FIGS. 3 and 12) located inside the main body 104 is provided with an electronic level gauge and the level gauge is wired to an alarm signal, such as to a light, an audible alarm, or both, when the oil level reaches a set level, such as to indicate that it is time to offload or empty the tank. Any number of commercially available electronic level gauges may be used to practice this aspect of the invention.

In an example, a software application can be provided for use with a smart electronic device, such as a smartphone, a tablet, or a computer. A controller on the oil change machine 100 can be programmed to wirelessly communicate with the software application running on the smart electronic device. The software application can be programmed to receive data from the oil change machine, such as elapsed time or time duration from when the project or job started, the volume of oil removed from an engine, the number of services since a start time or since the machine was last reset, total run time between maintenance, time between startup of the oil change machine and the pump startup or the first indication of pump flow. Alternatively, the controller on the oil change machine can store information and the software application can sync-up to the controller to view the data.

In an example, the oil change machine and the software application running on a smart electronic device can communicate wirelessly via Bluetooth, WI-FI, or cellular communication. Optionally, data from the oil change machine 100 can be loaded onto a cloud server and a technician or user can access the data via the internet using a web-based dashboard. Still optionally, the oil change machine can be provided with controllable switches, valves, and/or actuators to enable wireless and/or remote operation of the oil change machine. Conventional security and authentication can be incorporated to ensure data privacy.

Also shown in FIG. 1 is a set of wheels 144, 144 and a set of support stands 146, 146 for supporting the oil change machine 100. The oil change machine can be maneuvered by tilting the housing 102 back and then maneuvering the machine with the two wheels 144, 144. The wheels can be attached to a common axis and be of the type that can rotate together and/or relative to one another. Optionally, the wheels can be independently rotatable casters. The support stands 146, 146 can also optionally be independently rotatable casters, which would allow the oil change machine 100 to be maneuvered without having to tilt the machine.

A suction line or hose 150 is provided with the main body 104. In an example, the suction line 150 can project through an opening on the side of the main body 104 and then connected to a manifold or a multi-port valve, as further discussed below. A protective liner or sleeve 154 can be provided where the suction line 150 projects through the main body to protect the suction line from wear, abrasion, and/or kinking. As further discussed below, the machine end of the suction line 150 can terminate directly at the manifold or can connect to fittings that connect to the manifold. The length and opening size of the suction line 150 can be selected to ensure adequate flow and reach. Unless the context indicates otherwise, it is understood that various connections described herein can use conventional fittings and fasteners to secure, connect, and/or hold the various components.

A valve 156 can be provided at the opposite end of the suction line 150. In an example, the valve 156 can be a ball valve. In a particular example, the ball valve can be a quarter turn ball valve for quick turning of the ball stem to open or close the ball valve. A connection fitting 158 can be provided upstream of the valve 156, viewing from the direction of flow in the suction line 150 flowing from an external source into the oil change machine 100. As further discussed below, a draw hose assembly 200 (FIG. 4) having a hose and a mating fitting can connect to the connection fitting 158 at the suction line 150. The hose of the draw hose assembly 200 is configured to project into an opening of an engine to then allow the onboard mounted pump, via the suction line 150, to suction used oil out of the engine. That is, the oil change machine of the present invention uses suction from a pump to suction used oil, via a suction line or inlet line, directly from an engine. A plurality of draw hose assemblies can be provided with the oil change machine 100 for use with the suction line. Each draw hose assembly 200 is configured, such as being sized and shaped, for use with one or more engine types.

A support element 162 can be provided on the outside of the housing 102 to rest or hang the suction line 150. In some examples, more than one support element 162 can be provided. For example, a second support element can be provided for a dispensing line 164, another support element can be provided to support the valve 156 of the suction line 150, and yet another support element 162 can be provided to support the free end of the dispensing line 164, which can include a valve or a nozzle 166. In some example, the discharge end of the dispensing line 164 is provided with an open or free end only, without a valve or a controllable nozzle.

The length and opening size of the dispensing line 164 can be selected to ensure adequate flow and reach. As further discussed below, the oil change machine 100 can be adjusted, such as by changing the control settings, to allow the onboard pump 262 (FIG. 7) to dispense waste oil collected by the oil change machine 100. For example, the oil change machine can be configured to dispense or empty waste oil out the dispensing line 164, which can then discharge the waste oil into a waste reservoir or drum that can then be processed pursuant to protocols or regulations.

In an example, a valve 168 can be incorporated and connected to the discharge line of the onboard pump. As shown, the valve 168 is located upstream of the dispensing end or nozzle 166 of the dispensing line 164, viewing from the direction of flow of the dispensing line being from inside the oil change machine and then discharging out the free end of the dispensing line 164. The valve 168 can be a ball valve, which can be a quarter turn ball valve. The valve 168 can be connected via conventional fittings, connections, and/or terminations.

In an example, a compressed air single stage or multi-stage desiccant filter and regulator 170 is provided with an inlet 172 for filtering compressed inlet air, such as for filtering or drying moisture in the inlet compressed air. A valve 155 (FIGS. 12-14), which can be a ball valve, can be provided upstream of the filter and regulator 170. In an example, the desiccant filter and regulator 170 is available from Parker Filter Model 8003N-1A1-BX. However, other brands and types of filters can be practiced for filtering and drying compressed inlet air. The filter 170 should be selected to handle an inlet pressure of from about 100 psi to about 150 psi air supply. Air can be regulated down using the filter and regulator 170. As further discussed below, air entering and then exiting the filter and regulator 170 can be routed to the onboard pump to provide the energy for powering the air-driven pump. As further discussed below, the compressed inlet air can also be used to rotate an inline turbine generator to produce electricity for powering the various electronic components of the oil change machine.

The oil change machine 100 can be used as shown in FIG. 1 and placed directly on the shop floor of an oil change center or shop. The wheels allow the oil change machine to be maneuverable around the shop, such as to service different engines located on different bays or stalls of the shop. In other examples, the oil change machine 100 can be stationary and the inlet line and outlet line are selected with a respective length that can service multiple stalls or service bays without having to move the housing of the oil change machine. Wheels can be omitted from the stationary oil change machine 100.

In still other examples, the oil change machine 100 can be located on a service vehicle, such as on a service truck or a service van, and move from job site to job site to operate away from an oil change shop or center. For example, the oil change machine 100 can be located on a service truck and then lowered to the ground for use to change or remove oil from an engine.

In still other examples, the oil change machine 100 can be fitted onto a service vehicle or the inlet and outlet lines arranged in a way on the service vehicle that allows the housing of the oil change machine to remain on the vehicle while the oil change machine is being used to remove used oil from an engine. For example, the housing can be secured to an interior or a support surface of the service vehicle and a service door can be provided on the service vehicle. When the service door is opened, the technician can have access to the inlet line, the outlet line, and the control panel to operate the control switches, the power switch, and any other component of the oil change machine 100 needed for the full operation of the machine. Optionally, more than one service door can be provided on the service vehicle to access the various components of the oil change machine.

A service vehicle mounted or loaded oil change machine allows a technician to drive to a job site and then provide oil change services to one or more engines or vehicles at the remote job site. For example, it is foreseeable that a service vehicle mounted or loaded oil change machine can provide similar oil change services as oil lube shops or centers by driving to a job site, such as to a parking lot of a shopping center, a movie theater, a business complex, a sports complex, etc. and providing oil change services. Busy car owners may find it optimal to have their car engine oil replaced while they work, shop, or be entertained, such as while watching a movie or attending a sporting event. The car owner can save time and not have to drive to and from an oil lube center or car dealer to have the same service performed. The same can be performed at a boat yard, a boat dock, or a harbor. In other words, the oil change machine 100 of the present invention can be moved to a boat yard, a boat dock, or a harbor, and used to replace boat engine oil, such as for an inboard engine.

In an example, a second pump can be provided with the housing of the oil change machine or be provided in a separate housing. The second pump can be used to fill vehicle engines and/or boat engines with new oil. For example, new oil can be provided in an oil drum and the second pump can be used to pump new oil to fill vehicle engines and/or boat engines that had their used oil removed by the oil change machine 100 of the present invention. The second pump can operate by air or electric, as described elsewhere herein.

Figure 2:
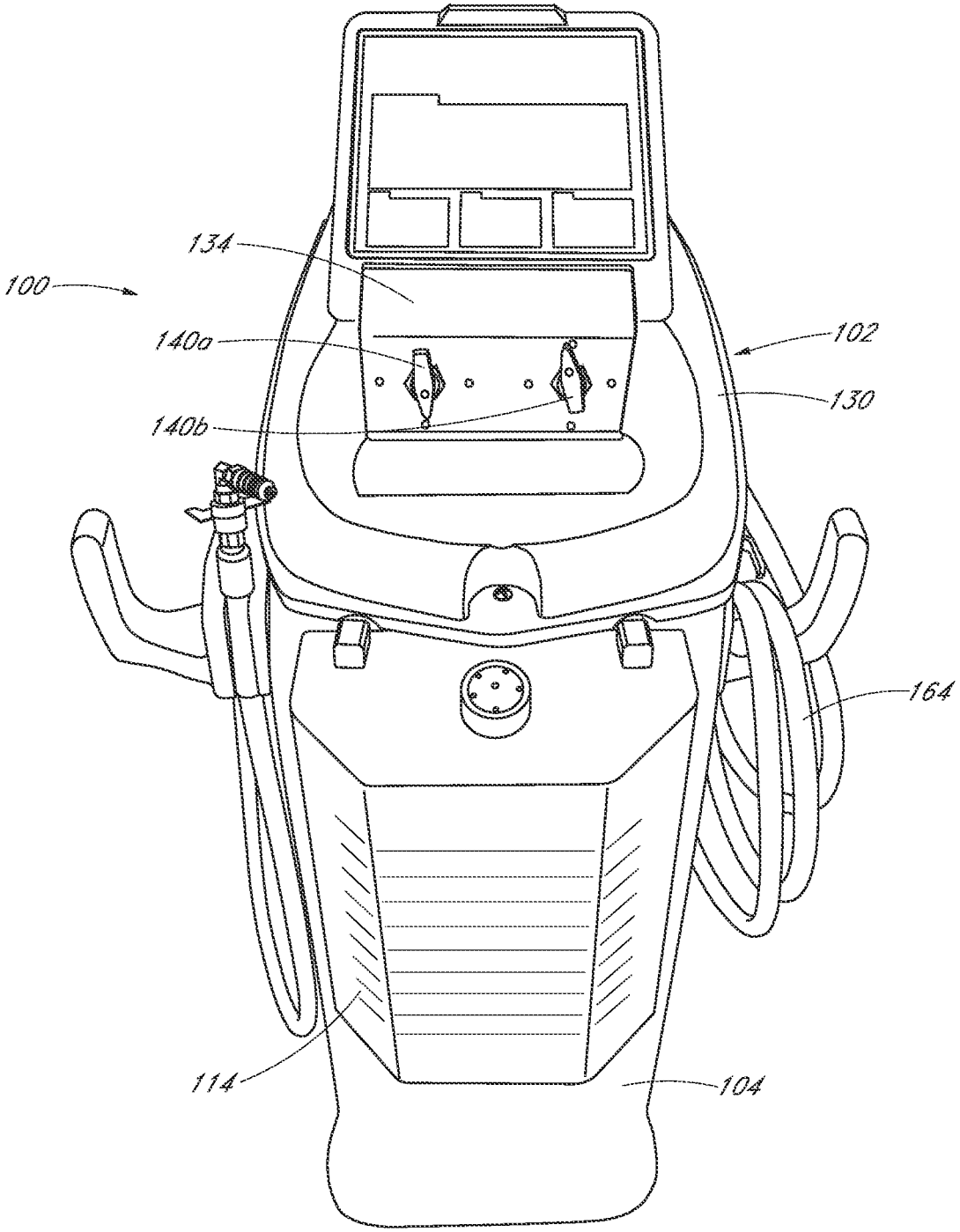
FIG. 2 is a partial perspective front view of the oil change machine of FIG. 1.

FIG. 2 shows a front perspective view of the oil change machine 100 of FIG. 1. Note that were the same components are parts are shown from earlier figures but not described or labeled, the parts are understood to be the same unless the context indicates otherwise.

Figure 3:
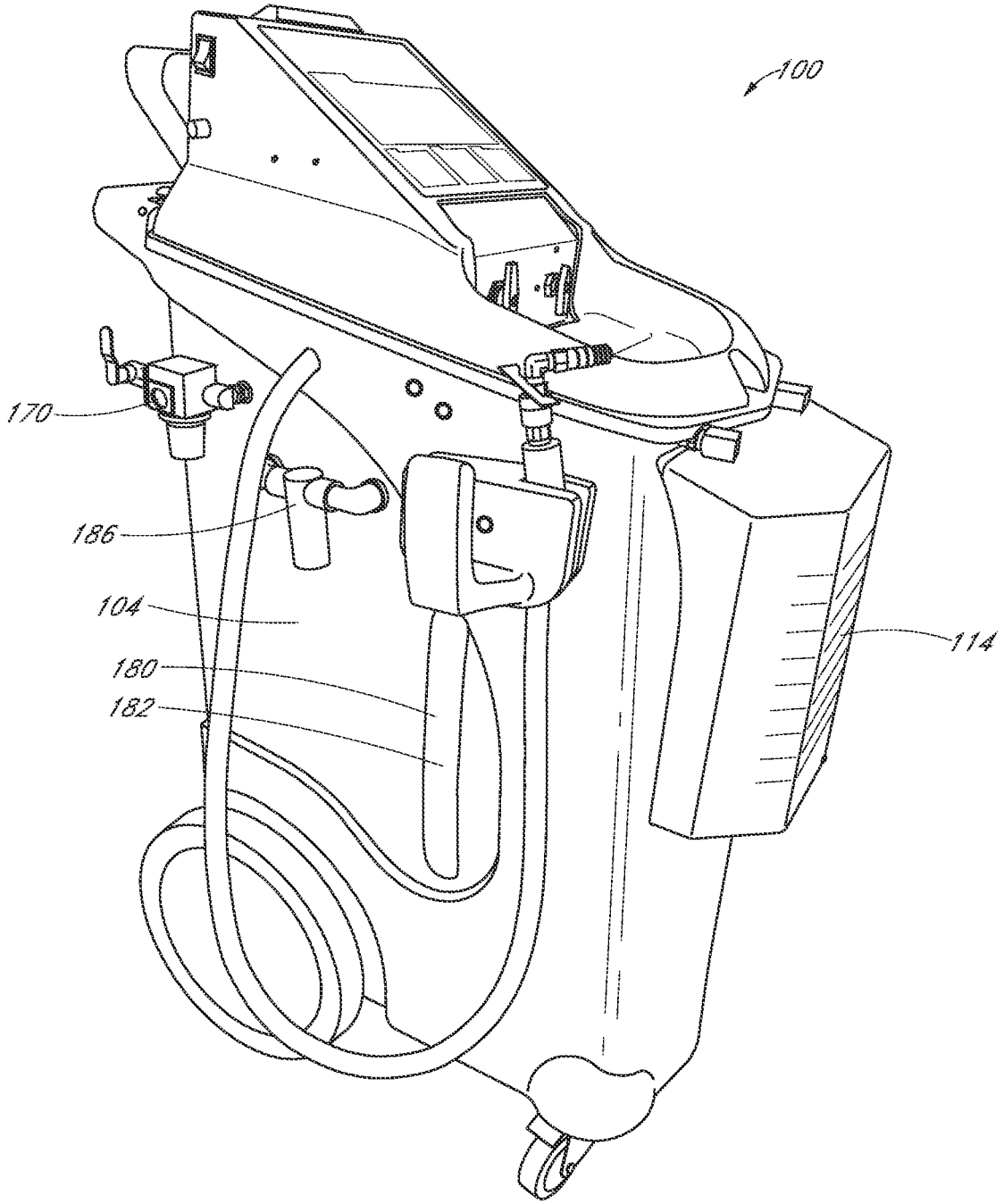
FIG. 3 is a partial side perspective view of the oil change machine of FIG. 1.

FIG. 3 shows a side perspective view of the oil change machine 100 of FIG. 1. In the view shown, a view opening 180 can be seen incorporated on the side of the main body 104. The view opening 180 has a perimeter defining the opening. The perimeter can be oblong in shape with other shapes contemplated. An onboard offloading tank 182 can be seen through the view opening 180. The size of the view opening 180, such as the length, can be selected to view the height of the offloading tank. As further discussed below, the offloading tank 182 can be incorporated to provide a storage space for temporarily holding used oil from multiple oil changes.

In an example, after removal of used oil into the service holding tank 114 from an engine, the recovered oil can then be transferred from the service holding tank 114 to the offloading tank 182. Preferably, the recovered oil can be transferred from the service holding tank 114 to the offloading tank 182 before each new job, or before removing oil from the next engine. This process of moving oil from a first tank to a second tank allows the technician to view the total volume of oil removed for each job since the service holding tank 114 was previously empty prior to the job in question.

In an example, the offloading tank 182 has a 15-gallon holding capacity. However, a tank with a different capacity, such as less than 15 gallons or greater than 15 gallons, may be used. The offloading tank 182 can be made from a transparent or a semi-opaque plastic material, which can be the same or different material from the service holding tank 114.

As used oil is transferred from the service holding tank 114 to the offloading tank 182, the oil level inside the offloading tank 182 rises. A technician can select to empty the offloading tank 182 when the level is full or near full capacity by looking through the view opening 180. An electronic level gauge may be used that will sound a local alarm and/or energize a warning light, and possibly not allow the oil change machine 100 to operate, unless the offloading tank is emptied and a reset button is pressed. The offloading tank 182 can be emptied by setting the controls on the control panel 134 to take suction from the offloading tank 182 and then discharge out the dispense line 164 to a waste drum or reservoir, as further discussed below.

Figure 7:
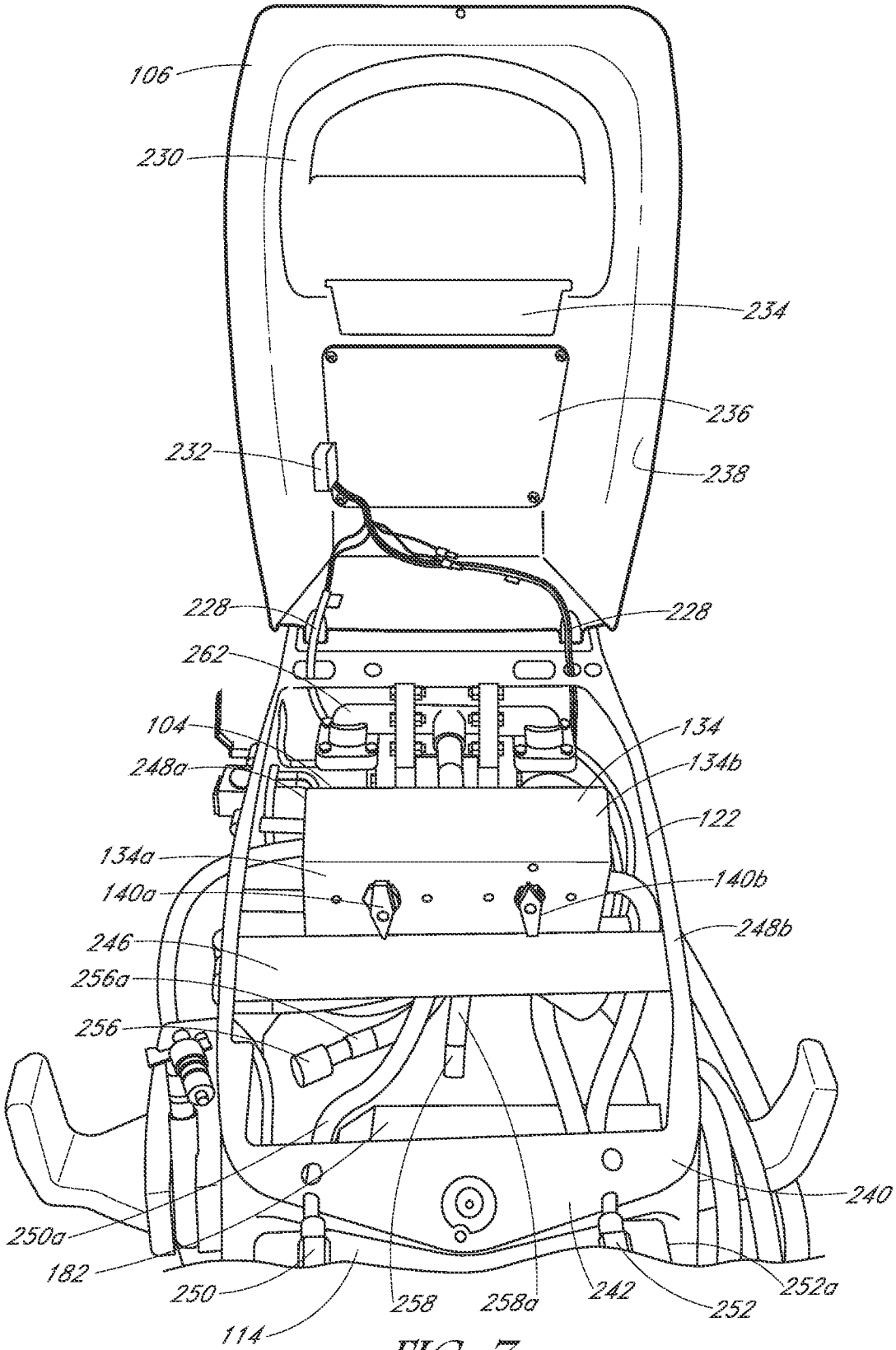
FIG. 7 is a top view of the oil change machine of FIG. 1 with the top section rotated away from the main body to expose the top opening and components located therein.

In an example, an in-line oil filter assembly 186 is provided with the oil change machine 100. In an example, the oil filter assembly 186 has a filter located inside a housing. An inlet line and an outlet line extend from the housing for passing oil through the housing and through the mesh filter to remove particles and solids. In an exemplary embodiment, the oil filter assembly 186 is positioned downstream of the inlet valve 156, but upstream of the inlet to the onboard pump 262 (FIG. 7). The oil filter assembly 186 is configured to filter the used oil before the used oil flows into the onboard pump. In an example, the oil filter assembly can be a micron-range screen filter with a valve located at the bottom of the housing of the oil filter assembly to allow draining of the housing. Other inline oil filter assemblies are contemplated, such as a Parker return line hydraulic spin-on filter, a Donaldson return line hydraulic filter assembly, an Ingersoll Rand standard general purpose filter, etc. The oil filter assembly 186 used with the oil change machine should be selected with values that minimize pressure requirement, i.e., minimize lift, of the onboard pump.

Figure 4:
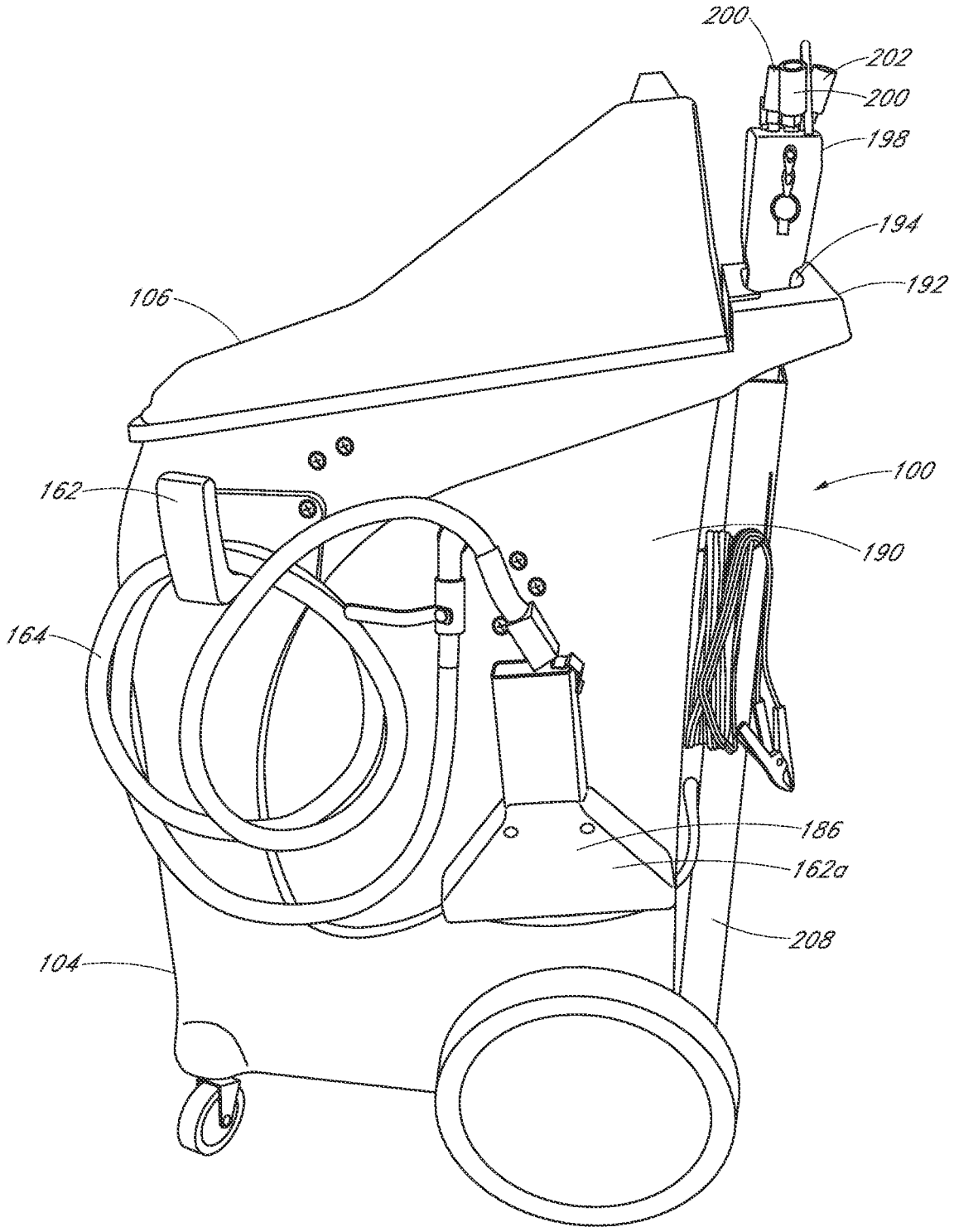
FIG. 4 is a side elevation view of the oil change machine of FIG. 1 from another viewing position.

FIG. 4 shows a right side view of the oil change machine 100 of FIG. 1. In the view shown, a pair of support elements 162, **162*a* can be seen. The first support element 162 can embody an extension or a hook for wrapping and hanging the length of the dispensing line 164. A second support element 162*a* can be provided for supporting the discharge end or free end of the dispensing line 164. In an example, the second support element 162*a* embodies a collection bin comprising a housing 186 having an opening for receiving the free end of the dispensing line 164. The housing 186 of the second support element 162*a* can have an interior that can collect overflow or spilled oil that may drip out from the dispensing line 164. In an example, the lower housing section of the housing 186 can be larger than the upper housing section to increase the storage capacity of the housing 186 for collecting spilled or overflow oil. The housing 186 can be equipped with a drain line or can be piped to the inlet of the onboard pump to pump away used oil that may collect inside the housing 186**.

In an example, a clamp 190 may be provided at the free end of the dispensing line 164. The clamp 190 is optional and when incorporated, helps to secure the free end to the housing 186 to a tank, such as a waste oil bin.

A handle 192 can extend from the rear of the main body 104. In an example, the handle 192 is unitarily molded with the main body. In another example, the handle is separately formed and subsequently attached to the main body 104. The handle 192 can be located closer to the upper end of the main body than the lower end of the main body. The handle 192 can have an opening 194, which can be a perimeter having a plurality of sides, such as a rectangular shaped opening.

A collection case 198 for holding or collecting a plurality of draw hose assemblies 200 can be provided. The collection case 198 can be sized and shaped to locate in the opening 194 of the handle 192. The collection case 198 can have a body defining an interior. The body of the collection case 198 can be sized and shaped to hold two or more draw hose assemblies 200. The collection case 198 can fit into the opening 194 of the handle 192 and can remain in place within the handle via friction or interference. The collection case 198 can be removable from the opening 194 of the handle 192. For example, when lifting the top housing section 106, such as to perform maintenance to the oil change machine 100, the collection case 198, along with anything located therein, can be removed to free up space for the top housing section 106 to swing open about a hinge or rotational axis near the back of the main body 104.

As previously discussed, each draw hose assembly 200 can comprise a mating fitting 202 and a hose extending from the mating fitting 202. The mating fitting 202 is shaped to mate with the connection fitting 158 on the suction line 150. The hose extending from the mating fitting 202 is configured to fit into a dipstick port or tube of a vehicle engine. The hose extending from the mating fitting allows the onboard pump to extract used oil directly from the engine, via the draw hose assembly 200 and the suction line 162. Suctioned oil can be discharged into the service holding tank 114 located in or on the housing 102, such as in the main housing section 104.

In some examples, each draw hose assembly 200 is configured to fit one or more dipstick ports or tubes of one or more engine types. For example, a first draw hose assembly 200 with a first hose size, either inside bore diameter or outside wall diameter, can fit into dipstick tubes of Mercedes engines, a second draw hose assembly 200 with a second hose size can fit into dipstick tubes of Lexis engines, a third draw hose assembly 200 with a third hose size can fit into dipstick tubes of inboard engines for a line of boats, etc.

For vast majority of engines, a seal is not required between the draw hose assembly 200, or between the mating fitting 202 of the draw hose assembly, and the inlet opening of the dipstick port. All that is necessary is to insert the hose of the draw hose assembly into the dipstick port or tube and making sure that the free end of the hose of the draw hose assembly 200 goes to the bottom of the oil pan to ensure suction of most if not all of the used oil from the engine by the oil change machine. For some engines, a seal may be necessary at the opening of the dipstick port to seal against the draw hose assembly 200. If required, any number of devices may be used to seal the dipstick port opening so that the dipstick port itself can be used as a suction line. In the case of a seal, the draw hose assembly 200 may not incorporate any hose extending from the mating fitting 202 or may incorporate a hose length that does not extend to the bottom of the oil pan. The seal will allow vacuum to build and oil to be withdrawn out through the port without having to extend any hose opening below the oil level in the pan.

A collection port 208 (FIG. 4) can be provided with the main body 104 and aligned with the opening 194 of the handle 192. The collection port 208 can comprise a housing having an interior space for accommodating a plurality of hose sections extending from the plurality of mating fittings 202 of the plurality of draw hose assemblies 200. The collection port 208 can be sized and shaped to accommodate the lengths of the various hose sections and large enough in girth to accommodate a plurality of hose sections. The collection port 208 can be attached directly to the main body 104 of the housing 102, such as by clamps or fasteners. The collection port 208 can be enclosed except for an upper opening or can include one or more through holes for venting. A drain line can be provided at the bottom of the collection port 208 for draining overflow or dripped oil and/or a suction line may be provided with the collection port 208 to allow overflow or dripped oil to be suctioned away by the onboard pump.

Figure 5:
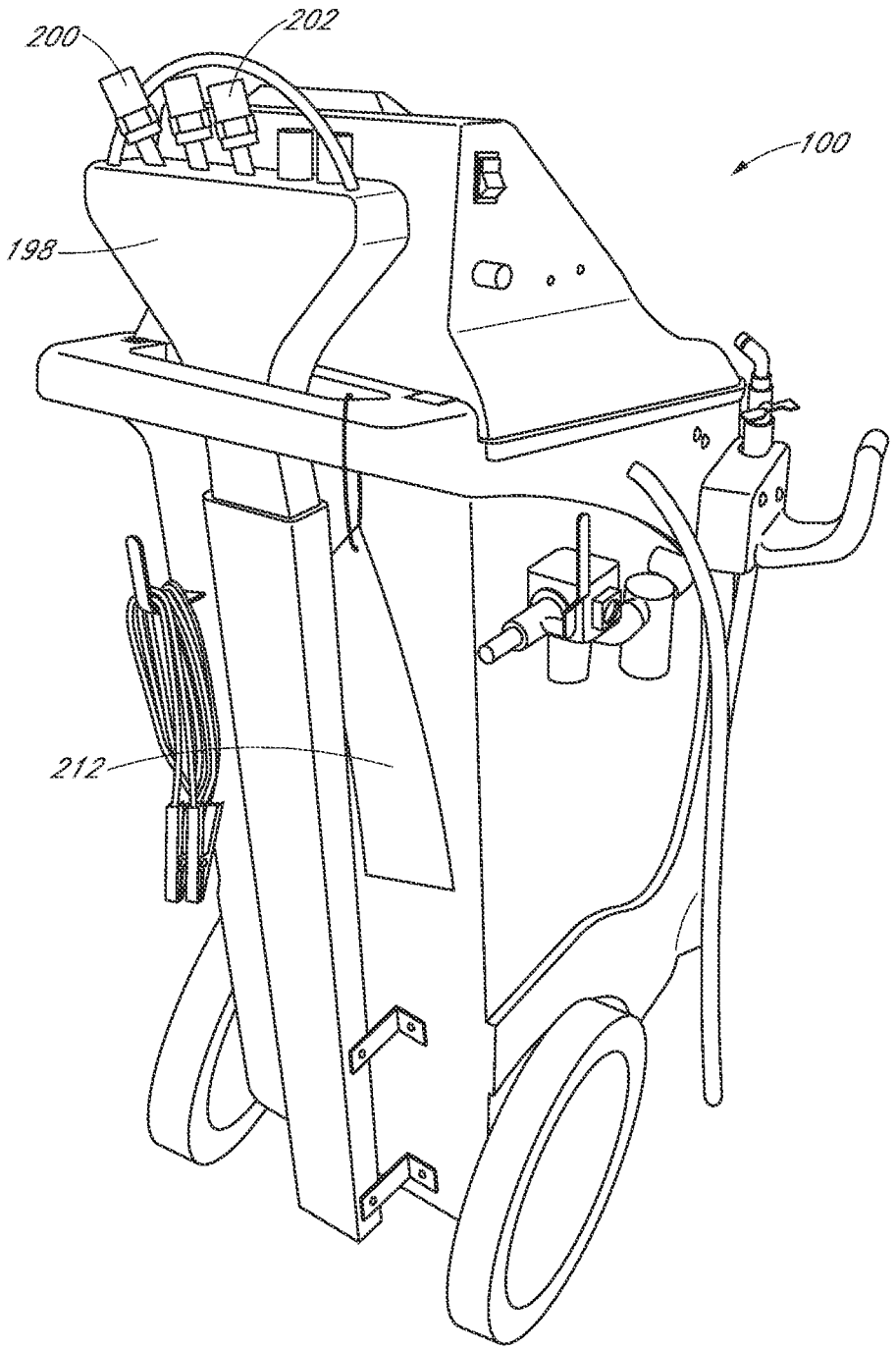
FIG. 5 is a partial rear perspective view of the oil change machine of FIG. 1.

FIG. 5 is a rear perspective view of the oil change machine 100 of FIGS. 1-4. As shown, an information placard or sheet 212 can be incorporated with the oil change machine 100. In an example, the information placard or sheet 212 can be a laminated placard with information regarding the plurality of draw hose assemblies 200. For example, each mating fitting 202 of each draw hose assembly 200 can be provided with a unique identifier (ID), which can be a unique color, shade, part number, or name. The information placard 212 can provide an index or a reference for each of the unique identifiers and a corresponding engine or a list of corresponding engines that the particular draw hose assembly with the particular unique ID can be used with. For example, a Mercedes E-class may have a dipstick tube with a 5/16-inch inside diameter, which may call for a draw hose assembly 200 with a blue color mating fitting 202, which may have a ¼-inch hose outside diameter and sized to fit into the 5/16-inch bore. Other draw hose assemblies may have other sized hoses attached to the respective mating fittings for use with other dipstick tube diameters.

Alternatively or additionally, the information on the information placard can be stored in a memory of an onboard controller and be available for viewing on a display screen on the top console 130. For example, a technician can enter a car type, car model, or an engine type into an input device to the onboard controller, or to a smart electronic device, and the particular draw hose assembly for use with the particular car type or engine will be displayed by the oil change machine or by the software app running on the smart electronic device. Still alternatively, the information on the information placard can be provided on the information panel 136.

Figure 6:
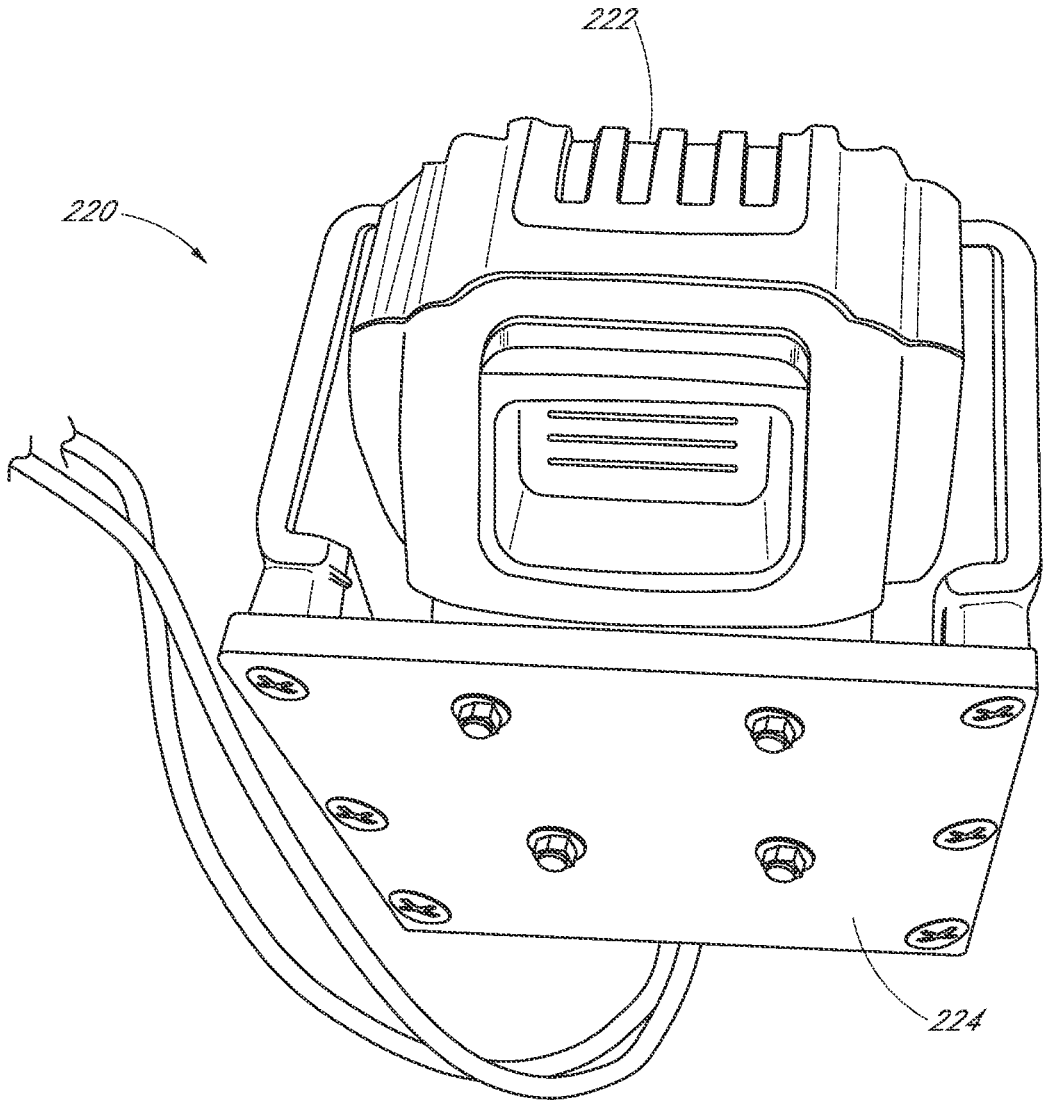
FIG. 6 is a perspective view of a power supply module in accordance with aspects of the invention.

With reference now to FIG. 6, a power module 220 comprising a rechargeable battery 222 and a power socket housing 224 comprising a pair of wires is shown. The rechargeable battery 222 can be a 12-Volt lithium-ion battery for powering the onboard electronics, such as to power a circuit board and/or a controller that controls the various electrical functions of the oil change machine 100. In an example, the power module 220 can be located inside the housing 102. For example, the power socket housing 224 can be secured inside the main body 104 and be accessible by lifting the top housing section 106. In other examples, the power socket housing 224 can be mounted to the outside of the main body 104 and then lead wires are routed inside the main body to power the onboard electronics.

The rechargeable battery 222 can be removed from the power socket housing 224 for charging with a battery charger. Optionally, more than one rechargeable battery 222 can be provided with the oil change machine 100 so that while one rechargeable battery 222 is being used to power the oil change machine, another can be charged and be ready for use.

In some examples, a jumper cable can be provided to connect to a 12-Volt sealed lead acid battery, which can be rechargeable, to power the electronic components of the oil change machine. The 12-Volt lead acid battery can be located external to the housing 102 of the oil change machine or be located internally of the main body of the oil change machine. Preferably, the lead acid battery is accessible if mounted internally of the main body, such as by providing a removable panel to allow access to the battery or mounting the battery so that is accessible via the top opening 122.

In still other examples, power to operate the oil change machine 100 can be provided with a 110 volt household AC power cord and then using a transformer to step the power down to a low voltage AC. Finally, the low voltage AC is routed through a rectifier to convert the AC power to a 12-Volt DC power to power the electronic components of the oil change machine 100. Typically, power from an AC power source can be routed through a converter to convert the AC power to DC power.

In still other examples, power to operate the electronics of the oil change machine can be provided with an inline turbine generator. For example, the inline turbine generator can have a housing with an air inlet and an air outlet. Pressure air routed through the air inlet can cause a fan or turbine located inside the housing to spin. Thus, air can provide the mechanical energy needed to operate the inline generator.

The turbine can connect to an armature and when the turbine spins, the armature spins within a stationary cage, call a stator. The rotating electromagnet of the armature spinning relative to the stationary magnetic field or stator produces electrical current, which can be converted to 12-Volt DC power. In an example, a SAVEMORE4U18 micro turbine generator rated at 10-watt and 12V DC can be used as the inline turbine generator. Other inline turbine generators may also be used, such as the WZINTOP 12V/10 W DC turbine generator. In an example, an inline turbine generator can be placed after the air filter regulator 170 and before the inlet to the onboard pump 262. The 12V output voltage can be used to power the various electronic components of the oil change machine.

In still other examples, the oil change machine can be assembled with more than one power supply configuration. For example, the oil change machine can be wired to operate with a 12-volt lead acid battery and with a 12-volt lithium ion battery as backup power. Alternatively, the oil change machine can be assembled with an inline turbine generator with a 12-volt lithium ion battery as backup power, etc. Any two or more of the combinations of power supplies described herein can be used, in any order as primary power and as backup or secondary power.

FIG. 7 is a partial front perspective view of the oil change machine 100 of the present invention. FIG. 7 shows the top housing section 106 flipped upwardly about a pair of spaced apart hinges 228 with different hinge arrangements contemplated. The underside surface 230 of the top section 106 is shown with electronics or electronic components 232, which include a plurality of wires, switches, and connectors. The electronics can include a controller, a printed circuit board (PCB), a memory, a communications module, a display module, etc. to provide the various data capture, display, communication, controls, and alert functions noted elsewhere herein. A top section opening 234 is provided in the top section 106 to expose at least part of the control panel 134 through the opening 234. As shown, the top section 106 can have a central surface 236 and a sidewall 238 depending from the central surface. The top section 106 can be considered generally as a half-shell shape with a top section opening 234.

The main body 104 is shown with a top flange 240 defining a top opening 122. The front section 242 of the top flange 240 can be provided with an enlarged surface area to provide added rigidity and space for mounting the service holding tank 114. A bracket 246, which can be a thin-wall piece of metal, connects to the two sides 248*a*, 248*b* of the main body. The bracket 246 can add strength to the main body and can provide support for the control panel 134, or can be used to mount or attach the control panel. In an example, the bracket 246 and the control panel 134 are integrally formed or unitarily formed. As shown, the bracket and the control panel are shaped using a thin metal sheet and includes bends that form sides or panels, which include a front or first control panel 134*a* and a top or second control panel 134*b*. The bracket 246 can be angled to the first control panel 134*a* and the second control panel 134*b* can be angled to the first control panel 134*a*. When the top section 106 is closed over the top opening 122, as shown in FIG. 2, the first control panel 134*a* and the second control panel 134*b* are exposed at the top section opening 234 of the top section 106. In other examples, only the second control panel 134*b* is exposed when the top housing section 106 is closed.

A first switch or handle 140*a* and a second switch or handle 140*b* can be mounted to the first control panel 134*a*, or optionally to the second control panel 134*b*. As further discussed below, the first handle 140*a* can be used to change flow configuration for a first manifold or first multi-port valve and the second handle 140*b* can be used to change flow configuration for a second manifold or second multi-port valve.

A plurality of flow connection points are provided with the service holding tank 114. In an example, a first service connection point 250 and a second service connection point 252 are incorporated with the service holding tank 114. Each flow connection point is connected to a flow line. In other examples, there can be additional connection points for terminating additional flow lines. As shown, the first service connection point 250 is connected to a first service flow line 250*a* and the second service connection point 252 is connected to a second service flow line 252*a*.

The offloading tank 182 is shown with a plurality of flow connection points. In FIG. 7, a first offloading connection point 256 and a second offloading connection point 258 are shown. Each flow connection point is connected to a flow line. In other examples, there can be additional connection points for terminating additional flow lines, as further discussed below. The first offloading connection point 256 is connected to a first offloading flow line 256*a* and the second offloading connection point 258 is connected to a second offloading flow line 258*a*.

Also shown is a diaphragm air driven pump 262. In an example, the pump is a Husky 716 Air Diaphragm Pump manufactured by Graco. The pump can have an aluminum or a stainless steel casing with polypropylene seats and Buna-N diaphragms. As shown, the pump is rated for maximum operating air pressure of 100 psi and 16 gallons per minute (gpm) free flow delivery. The pump is rated for 15 feet suction lift dry and 25 feet suction lift wet. In other examples, the pump can be rated for different flow rates and different suction lifts. In some examples, the pump 262 can be an electrically driven pump. For example, the pump can be a diaphragm pump that is electrically driven, such as with 12V DC or 24 V DC power supply input. An exemplary electrically driven diaphragm pump is a 2" Mud Sucker 2FAC-EC pump or 2" Mud Sucker 2FAC-EC-DD pump.

Figure 8:
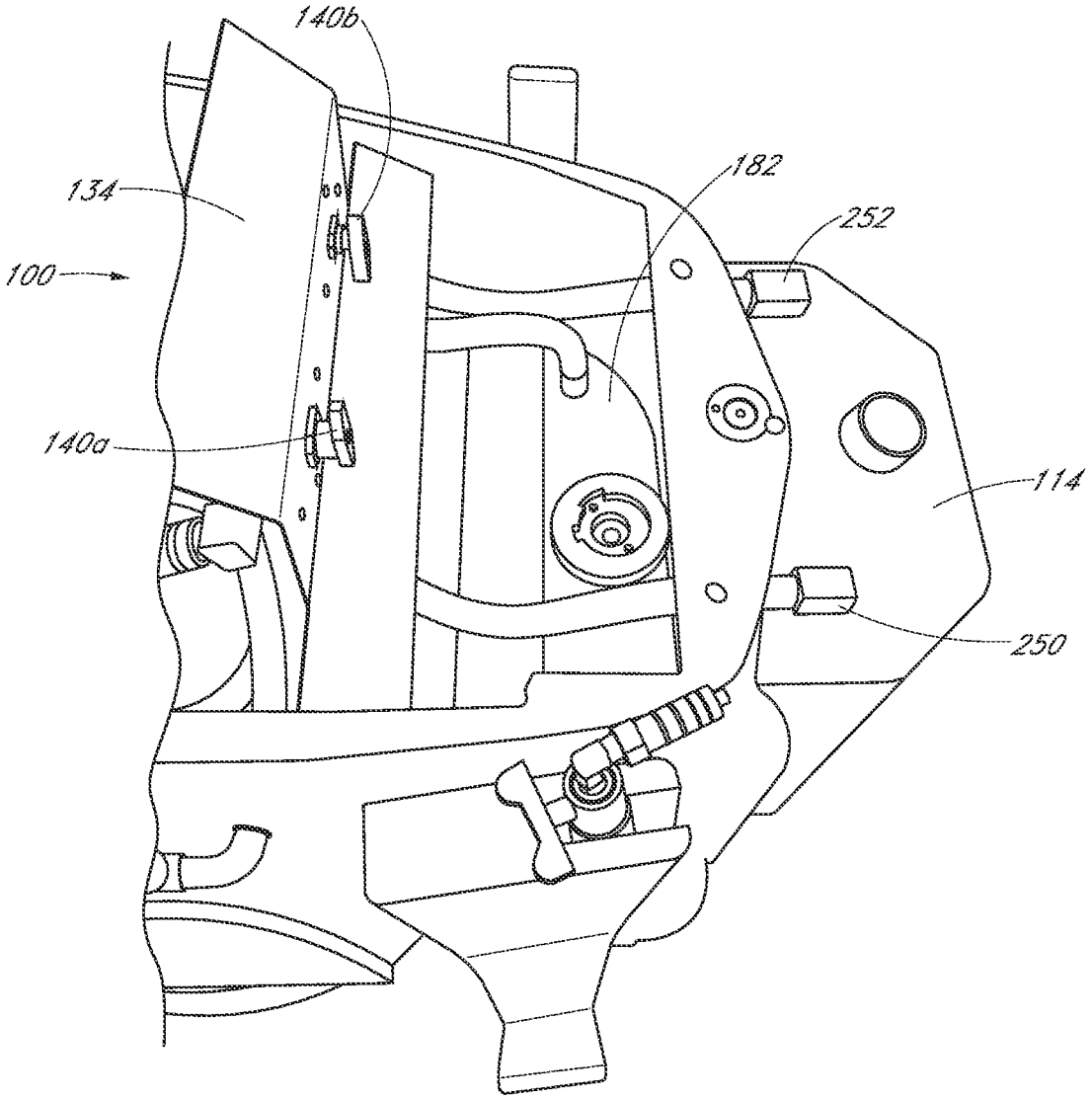
FIG. 8 is a close-up view of the exposed top opening of FIG. 7 from a different viewing position.

FIG. 8 is a closed-up top perspective view of the oil change machine of FIGS. 1-7.

Figure 9:
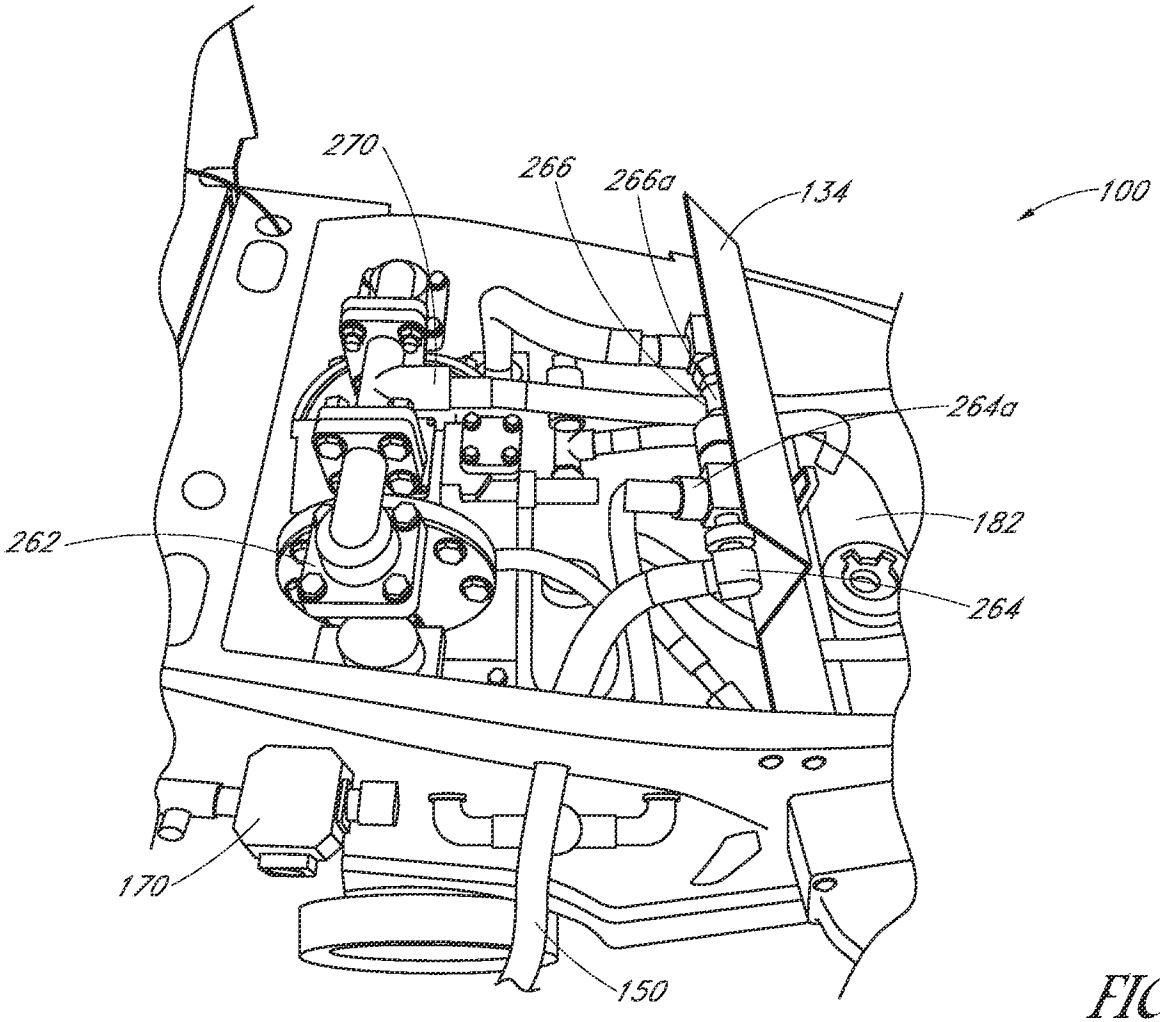
FIG. 9 is a close-up view of the exposed top opening of FIG. 7 from a different viewing position.

FIG. 9 is a closed-up top perspective view of the oil change machine of FIGS. 1-7, similar to FIG. 8. The pump 262, the offloading tank 182, the control panel 134, the suction line 150, and the inlet air filter 170 are clearly shown in FIG. 9. Also shown is a first multi-port valve 264 connected to the first control handle or switch 140*a* and a second multi-port valve 266 connected to the second control handle or switch 140*b*. As further discussed below, rotation and positioning of the first and second switches 140*a*, 140*b* will configure different inlet and outlet line configurations to and from the pump 262 to extract and move used oil to different holding tanks or to dispense the used oil in a disposable or recyclable bin or container.

In an example, the first multi-port valve 264 is a 4-way valve. That is, the first multi-port valve 264 can have one outlet and three different inlets. In other examples, the first multi-port valve 264 can have a different port configuration, such as one outlet and two inlets. The first control handle or switch 140*a* can be manipulated, such as rotated or turned, to change the position of the valve core of the 4-way valve of the first multi-port valve to change which of the three inlets is placed in fluid communication with the single outlet. In the example shown, the multi-port valve 264 is an Anderson Brass Company (ABCO) 4-way valve, part number 4222BVNNXN-3. As further discussed below, the first multi-port valve 264 can be used with the inlet to the pump 262. In an example, three different inlets can be configured to connect to the outlet of the first multi-port valve 264 to then connect to the inlet of the pump.

In an example, the second multi-port valve 266 is a 3-way valve. That is, the valve 266 can have two outlets and one inlet. In other examples, the second multi-port valve 266 can have a different port configuration, such as three outlets and one inlet. The second control handle or switch 140*b* can be manipulated, such as rotated or turned, to change the position of the valve core of the 3-way valve of the second multi-port valve to change which of the two outlets is placed in fluid communication with the single inlet. In the example shown, the multi-port valve 266 is an Anderson Brass Company (ABCO) 3-way valve, part number 3222BVNNXN. As further discussed below, the second multi-port valve 266 can be used with the outlet of the pump 262. In an example, the pump discharge can be routed to the one inlet of the second multi-port valve 266 and to different outlets from the second multi-port valve 266, depending on the position of the second control 140*b*, to change where the used oil is routed, as further discussed below.

In FIG. 9, the pump discharge 270 is shown connected to the inlet 266*a* of the second multi-port valve 266 and the single outlet 264*a* from the first multi-port valve 264 is shown with a line, which is routed to the pump inlet.

Figure 10:
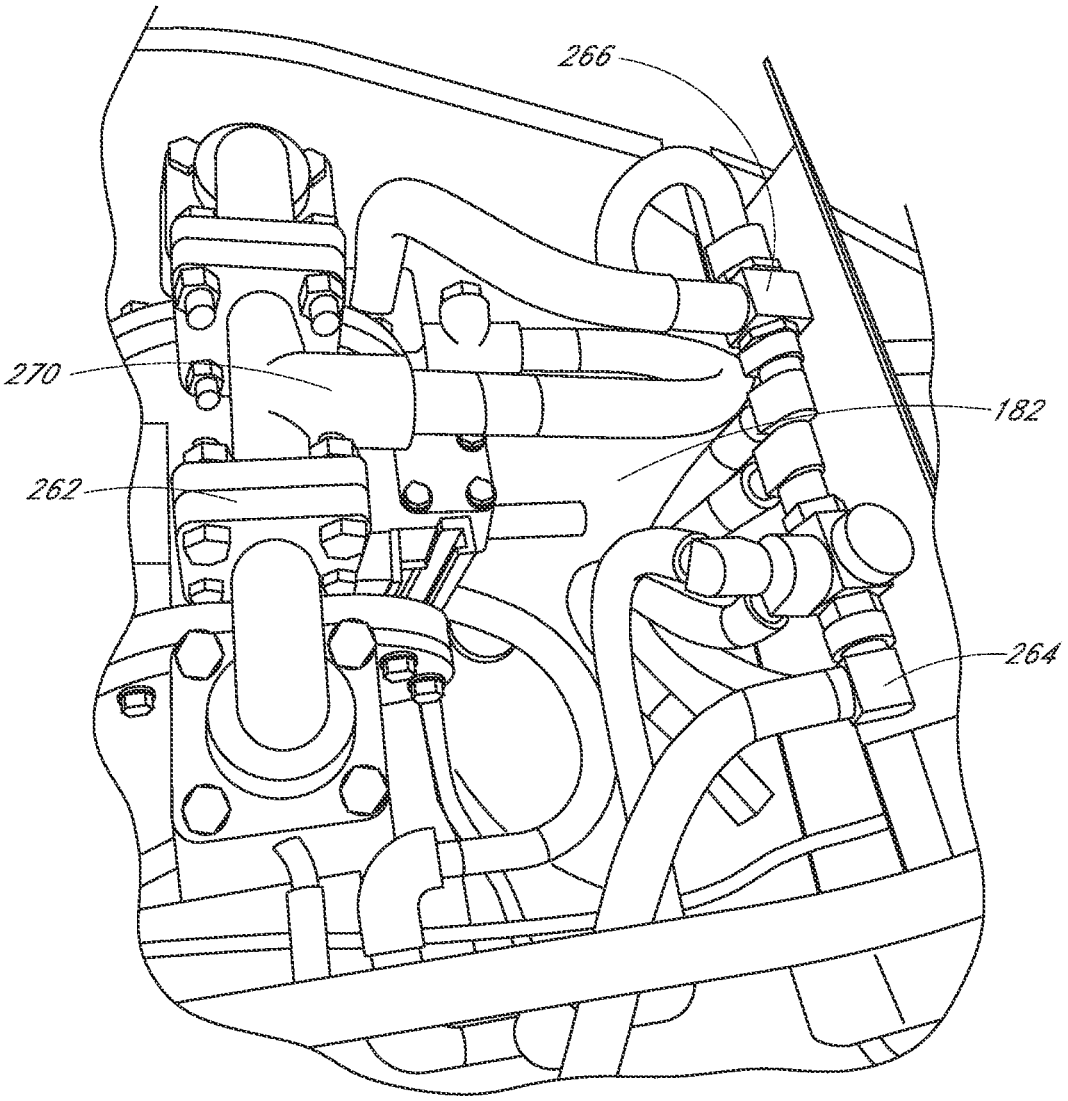
FIG. 10 is a close-up view of the exposed top opening of FIG. 7 from a different viewing position.
Figure 11:
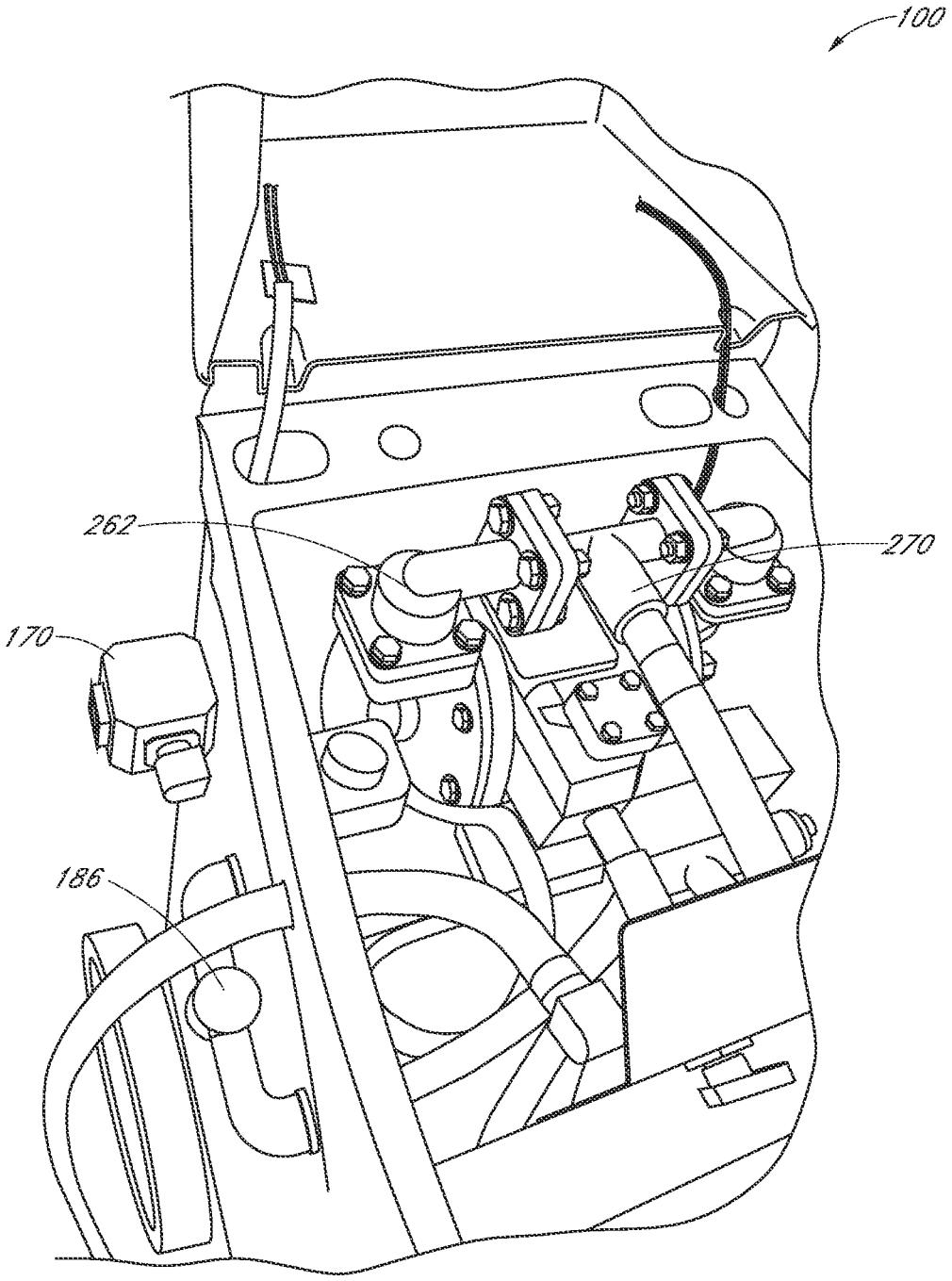
FIG. 11 is a close-up view of the exposed top opening of FIG. 7 from a different viewing position.

FIG. 10 is a closed-up top perspective view of the oil change machine of FIGS. 1-7, similar to FIG. 9. The pump discharge 270, the air inlet to the pump 262, and the pump inlet 274 are clearly shown in FIG. 10. A foundation or base 278 is provided below the pump 162. The foundation 278 can be a rigid metallic plate fastened to the inside of the main body 104 to provide a surface to support the pump 162. The pump 162 can be placed on the foundation 278 and the various flow line connections hold or steady the pump on top of the foundation or the pump can be secured to the foundation 278 using one or more fasteners.

Operations of the oil change machine will now be discussed with reference to FIGS. 12-14 and with continued reference to FIGS. 1-11 for the various parts or components previously described and named. Turn initially to FIG. 12, a process flow diagram depicting a flow configuration for the oil machine 100 of the present invention is shown, which can be understood as an initial flow configuration or first flow process for the oil change machine of the invention. The first flow process can be considered as a process for the removal of used oil from an engine. The process starts first by providing power to the oil change machine 100. One of the four ways that power can be supplied to the oil change machine 100 discussed above may be used, which can include using household power and converting the AC power to 12V DC, using a 12V portable and rechargeable lithium ion battery, using a 12V sealed lead acid battery, or using air to power an inline turbine generator. For discussion purposes, it will be assumed that power is provided with an inline turbine generator so that connection of an air supply line to the air filter and regulator 170 will provide both DC power to the electronic components and air motive force to the onboard pump 262. The air inlet valve 155 upstream of the filter regulator 170 should be closed prior to or when connecting the compressed air supply source.

If not already turned, the first control handle or switch 140*a* connected to the first multi-port valve 264 (FIG. 9), which can be color-coded in red, should be turned so that the narrow tip end of the switch is pointed to the left and the second control handle or switch 140*b* to the second multi-port valve 266, which can be color-coded in black, should be turned so that the narrow tip end of the switch is pointed to the right.

Next, the oil dipstick to the engine is removed. Using information provided with the oil change machine or a software app running on a smart electronic device, select the appropriate draw hose assembly 200 (FIGS. 4 and 5) for use with the engine and then couple the mating fitting 202 of the draw hose assembly 200 with the connection fitting 158 on the suction line 150. The hose of the draw hose assembly 200 can now slide into the dipstick tube or port of the vehicle being serviced. The hose of the draw hose assembly 100 should slide deep into the dipstick tube, making sure that the inserted end of the hose is below the oil level, preferably touching the bottom of the oil pan of the engine.

Next, open the valve 156 on the suction line 150 and the valve 155 on the air inlet to begin operating the pump 262, which will create or form a vacuum on the inlet side 276 (FIG. 11) of the pump. As soon as sufficient vacuum is generated on the inlet side 276 of the pump 262, used oil from the engine undergoing service will begin to flow out from the engine and into the hose of the draw hose assembly 200 and into the suction line 150. The used oil will first flow through the first inlet port or left port 264*b* of the first multi-port valve 264 and then out through the outlet port 264*a*, shown as the center port in FIG. 12, of the first multi-port valve 264. Outlet flow from the outlet port 264*a* can then travel through a mesh filter 186 (See also FIG. 3) before entering the inlet 276 of the pump 262.

After the used oil travels through the pump 262 and exits the pump discharge 270 (See also FIG. 9), it travels through the discharge line 164 (See also FIG. 1) and then through a four-way cross-manifold 280, which has four ports that are open or are in fluid communication with one another. Three of the four ports 280*a*, 280*b*, 280*c* can be used for routing discharge flow while the fourth port 280*d* can be used with a pressure relief valve 284 for safety. For example, if the dispense line 164 is blocked at the discharge valve 168 (See also FIG. 1) and the second multi-port valve 266 is blocked, the relief valve 284 can open to release pressure and allow oil flow to circulate back into the offloading tank 182.

Figure 12:
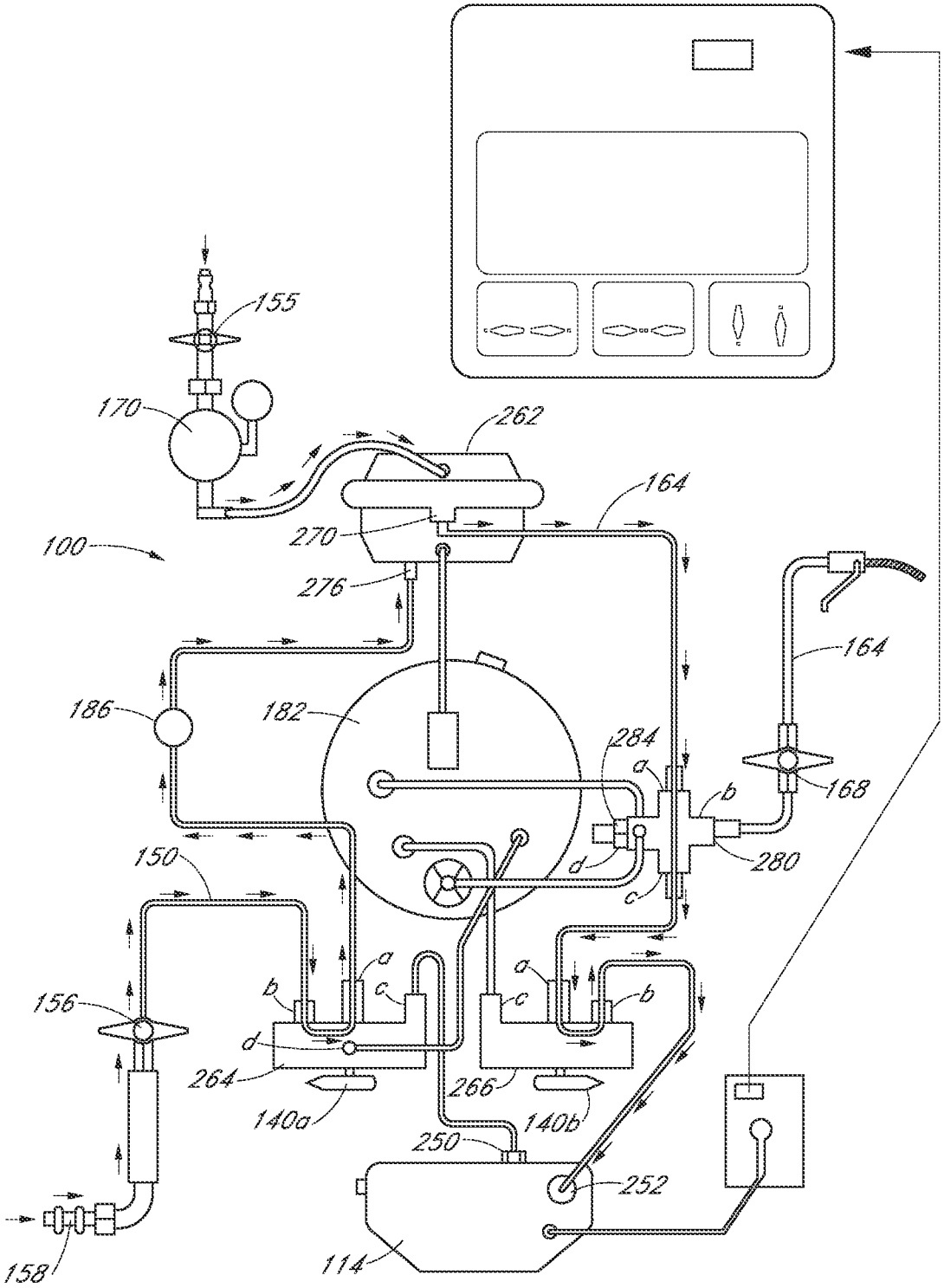
FIG. 12 is a process flow diagram depicting the operation of the oil change machine of FIGS. 1-11 undergoing a first process.

As shown, used oil flow exiting the 4-way cross-manifold 280 enters the inlet 266*a* to the second multi-port valve 266, shown in FIG. 12 as the middle port, and then exits the first outlet port 266*b*, or the right port shown in FIG. 12, and into the inlet port or inlet connection point 252, also referred to as the second service connection point, of the service holding tank 114.

The pump 262 can be allowed to run until all or substantially all of the oil is removed from the engine oil pan. In practice, the technician can visually observe oil spilling in through the inlet port 252 of the service holding tank 114 and/or oil flowing through the transparent or semi-transparent inlet line 150 to determine whether all or substantially all of the oil has been removed from the engine. It may be practical to check the draw hose assembly 200 at the dipstick port from time-to-time during the oil removal process to ensure that the hose of the draw hose assembly 200 remains properly positioned inside the dipstick port.

Once all or substantially all of the used oil has been removed, the valve 155 at the air supply to the regulator 170 is closed off and the valve 156 at the inlet line 150 is closed off. The hose of the draw hose assembly 200 is then removed from the dipstick port, the draw hose assembly removed from the connection fitting 158 of the suction line 150, and the dipstick placed back into the dipstick port. The draw hose assembly 200 can be placed back into the collection case 198 at the back of the oil change machine 100. The first step or the oil removal step is now complete.

In practice and before the next process of the oil change machine is carried out, the engine oil filter can be replaced and new engine oil added into the engine in through the engine oil opening, which can subsequently be closed off by an engine oil filler cap. Replacing the oil filter and replenishing the oil before performing the next process to the oil change machine 100 will allow the technician to finish with the customer earlier than if the next step is performed first and the oil change and new oil addition are performed last.

Next, used oil from the service holding tank 114 is removed. This process should be performed before the oil change machine is used again to remove used oil from another engine to be serviced as it is preferred to operate the oil change machine 100 with an empty or nearly empty service holding tank 114 before each service. However, it is not mandatory to empty the service holding tank before using the oil change machine on the next vehicle to be serviced, only preferred so that the total oil removed for each car can be measured via the measuring marks on the service hold tank 114. If used oil is already present in the service holding tank 114, it may be difficult to calculate the quantity of oil removed from the immediate engine being worked on, unless the prior level is marked and then deducted from the used oil volume for the next vehicle.

Figure 13:
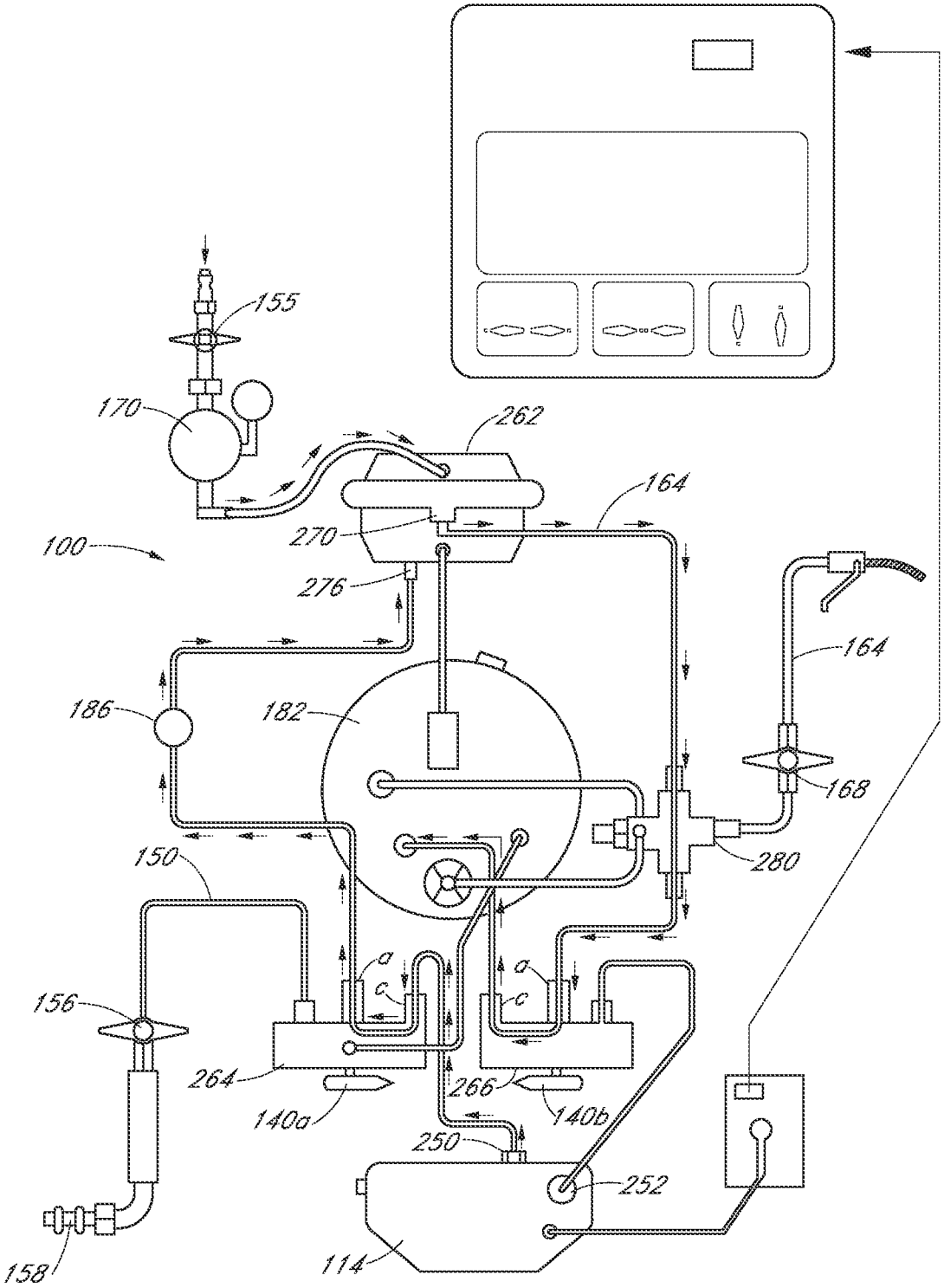
FIG. 13 is a process flow diagram depicting the operation of the oil change machine of FIGS. 1-11 undergoing a second process.

With reference now to FIG. 13 in addition to FIGS. 1-12, connect the air supply line to the air inlet, upstream of the air filter and regulator 170, if not already connected. Ensure that the inlet air valve 155 is closed, if not already closed. At the control panel 134 (FIG. 1), manipulate the first control handle or switch 140*a* connected to the first multi-port valve 264 so that it is rotated horizontally and the narrow end of the handle pointed to the right. The second control handle or switch 140*b* connected to the second multi-port valve 266 can be rotated horizontally so that the narrow end of the handle pointed to the left.

Next, the valve 155 at the air regulator 170 is opened, which supplies motive air to the onboard pump 262 to begin creating or forming a vacuum at the pump inlet 276. When sufficient vacuum is generated at the inlet, oil is sucked from the service holding tank 114 and flows through the second inlet 264*c*, at the first multi-port valve 264, or the right port shown in FIG. 13, and out the center port 264*a* of the first multi-port valve 264. Used oil from the service holding tank 114 then flows through the inline mesh filter 186 and into the inlet 276 of the pump 262.

After the oil travels through the pump 262 and out the pump discharge 270, it flows through the four-way cross-manifold 280 and into the center port 266*a* of the second multi-port valve 266. Because of the position of the second control switch or handle 140*b*, flow exits the second outlet 266*c* of the second multi-port valve 266, shown as the left port of the second multi-port valve in FIG. 13, and into the offloading tank 182. This allows used oil to move or transfer from the service holding tank 114 into the offloading tank 182. Preferably, this process is performed before the oil change machine is used on each new or different vehicle to be serviced.

Once the service holding tank 114 is emptied, the valve 155 to the air inlet can be closed to stop the pump 262. In practice, the technician can visually observe the service holding tank 114 and/or oil flow through the transparent or semi-transparent line leading from the tank 114 to determine if the process is complete. The service holding tank 114 emptying process is now complete.

Next, used oil from the offloading tank 182 is removed. However, this process is not required after every oil change since the offloading tank storage capacity is much larger than the service holding tank 114. For example, the offloading tank 182 can be emptied after about fifteen oil service changes. As previously noted, a technician can view the oil level of the offloading tank 182 through the view opening 180 of the housing to determine whether oil should be emptied from the offloading tank. In an example, an electronic level gauge is provided and is wired to alert the technician of the need to empty the offloading tank 182 after the oil level reaches a certain height level. The alert can be programmed to not allow a new oil service to carry out and can require that the offloading tank be emptied before the oil change machine can reset. As previously discussed, the level gauge can be wired to a controller which then controls a service light and/or an audible alarm to alert the technician of the need to empty the offloading tank 182. However, the technician can empty the offloading tank at will without having to first wait for the level alert or signal.

Figure 14:
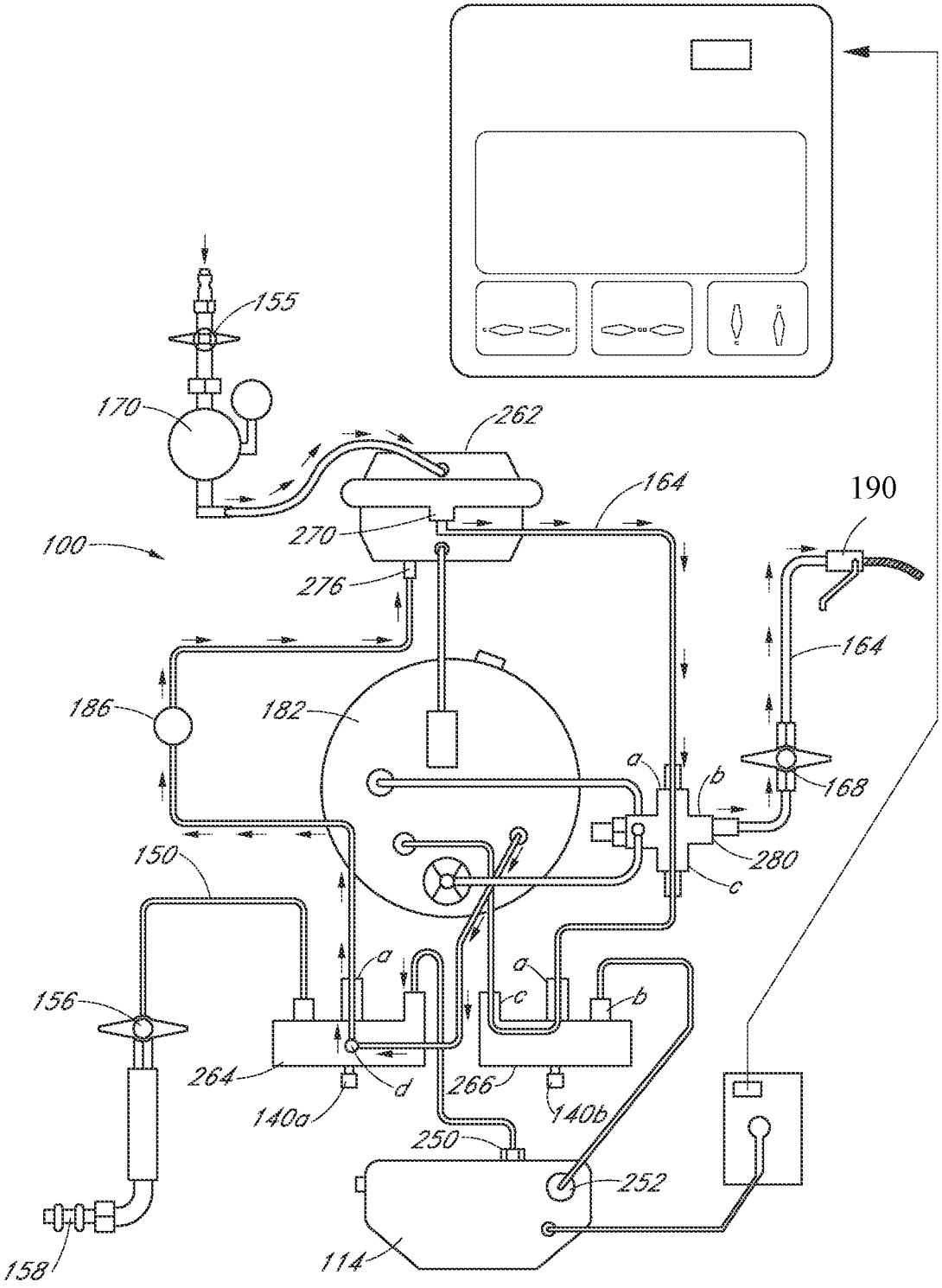
FIG. 14 is a process flow diagram depicting the operation of the oil change machine of FIGS. 1-11 undergoing a third process.

With reference now to FIG. 14 in addition to FIGS. 1-13, the process starts with connecting the air supply line to the air inlet, upstream of the air filter and regulator 170, if not already connected. Ensure that the inlet air valve 155 is closed, if not already closed. At the control panel 134 (FIG. 1), manipulate the first control handle or switch 140*a* connected to the first multi-port valve 264 by rotating the switch vertically so that the narrow end of the handle is pointed to the downward position. The second control handle or switch 140*b* connected to the second multi-port valve 266 can then be rotated vertically so that the narrow end of the handle is pointed to the upward position.

In other examples, the particular orientations of the narrow end or of the control switches can be different provided the flow configuration for the first and second multi-port valves follow the flow configurations described herein.

Next, take the dispensing line 164 (See also FIG. 1) and secure the discharge end of the dispensing line to a designated oil waste drum, using a clamp or other clamp means 288 if necessary to secure the end to limit unwanted spilling. Next, open the valve 168 to the dispensing line 164 to enable flow.

Next, the valve 155 at the air regulator 170 is opened, which supplies motive air to the onboard pump 262 to begin creating or forming a vacuum at the pump inlet 276. When sufficient vacuum is generated at the inlet, oil is sucked from the offloading tank 182 and flows through the third inlet 264*d* at the first multi-port valve 264, or top port shown in FIG. 14, and out the center port 264*a* of the first multi-port valve 264. Used oil from the offloading tank 182 then flows through the inline mesh filter 186 and into the inlet 276 of the pump 262.

After the oil travels through the pump 262 and out the pump discharge 270, it flows through the four-way cross-manifold 280 and out one of the ports 280*b* of the four-way cross-manifold 280, which is shown as the right port in FIG. 14.

The dispensing line 164 is connected to the right port of the four-way cross-manifold 280. Waste oil from the offloading tank 182 can therefore be emptied out the dispensing line 164 and into a designated waste oil drum when carrying out this third process. Because of the position of the first control switch or handle 140*a* and the second control switch or handle 140*b*, oil can be removed from the offloading tank 182 and emptied into an oil waste bin.

When oil stops flowing out the offloading tank 182 or when oil stops flowing out the dispensing line 164, the offloading tank 182 can be considered emptied. The valve 155 to the air inlet can now close to stop the pump 262. The valve 168 at the dispensing line 164 can now close and the dispensing line can be coiled up and stored at the support member 162. The offloading of the offloading tank is now complete.

In some examples, the oil change machine can be practiced with just the service holding tank 114, without the offloading tank 182. In this alternative embodiment, the used oil suctioned into the service holding tank 114 can be sized to hold multiple oil batches removed from multiple cars, the service holding tank 114 can be emptied as frequent as necessary to accommodate used oil, or the service holding tank 114 can be emptied after each engine oil removal event. Additionally, the oil change machine can be practiced on a stationary base without any wheels or the housing of the oil change machine can be mounted directly on a wall or on a support structure, such as a beam or a frame.

In the embodiment without the offloading tank 182, the first and second multi-port valves 264, 266 can be modified to operate with fewer flow configurations or excess ports can simply be plugged off or capped off with plugs or caps. The housing can also be modified or simplified for use without the offloading tank 182.

In an example and to empty the service holding tank 114, for an embodiment without the offloading tank 182, the first and second switches 140*a*, 140*b* can be adjusted so that suction to the pump is taken from the service holding tank 114 and the discharge side of the pump is routed directly to the dispensing line 164 to be emptied into a designated waste oil bin. The machine without the offloading tank 182 can have the same suction configuration with the plurality of draw hose assemblies as described elsewhere herein. The pump can be a positive displacement diaphragm pump, using compressed air or electricity for the power supply to the pump.

The process of removing used oil from another engine and for operating the oil change machine can repeat as discussed with reference to FIGS. 12-14.

In another example, an oil change machine can be configured to drain at least two vehicles simultaneously. In this alternative embodiment, two positive displacement pumps are incorporated into the same housing, which can have different panels, compartments, and brackets to support two separate pumps, along with associated hoses, valves, filters, manifolds, etc. for operating the oil change machine, in the manner described elsewhere herein. Each pump can be paired to a service holding tank but not an offloading tank. In other words, the alternative multi-pump oil change assembly can exclude a locally mounted offloading tank.

A housing can be provided with two vacuum pumps, two service holding tanks, valves, switches, hose lines, etc. to simultaneously perform two oil drain services on two different vehicles. When used oil is drained from a vehicle using one of the two pumps, using a draw hose assembly in the manner described above with reference to FIGS. 1-14, the used oil is emptied into a respective service holding tank paired with the pump. Thus, the housing of the alternative embodiment can accommodate two service holding tanks, one for each pump. The two pumps can be positioned one on top of the other or back-to-back within the housing. The two service holding tanks can similarly be positioned one on top of the other or back-to-back within the housing.

Two different sets of switches and operating components for the two pumps can be arranged to conveniently face two different users. For example, if the alternative oil change machine with two pumps is used between two different service bays, each set of controllers, inlet and outlet hoses, etc. can be conveniently located to face two different users.

Before the next oil change service is performed using the same pump of the multi-pump oil change machine, the used oil from the corresponding service holding tank can be drained into a designated waste bin instead of to an offloading tank mounted with the housing. After draining used oil from the service holding tank, the switches on the control panel can be adjusted to cause the pump to draw a suction on the suction line for drawing used oil for the next vehicle and so forth. Simultaneously, the second pump located in the same housing can be used to drain oil from another/different vehicle.

Figure 15:
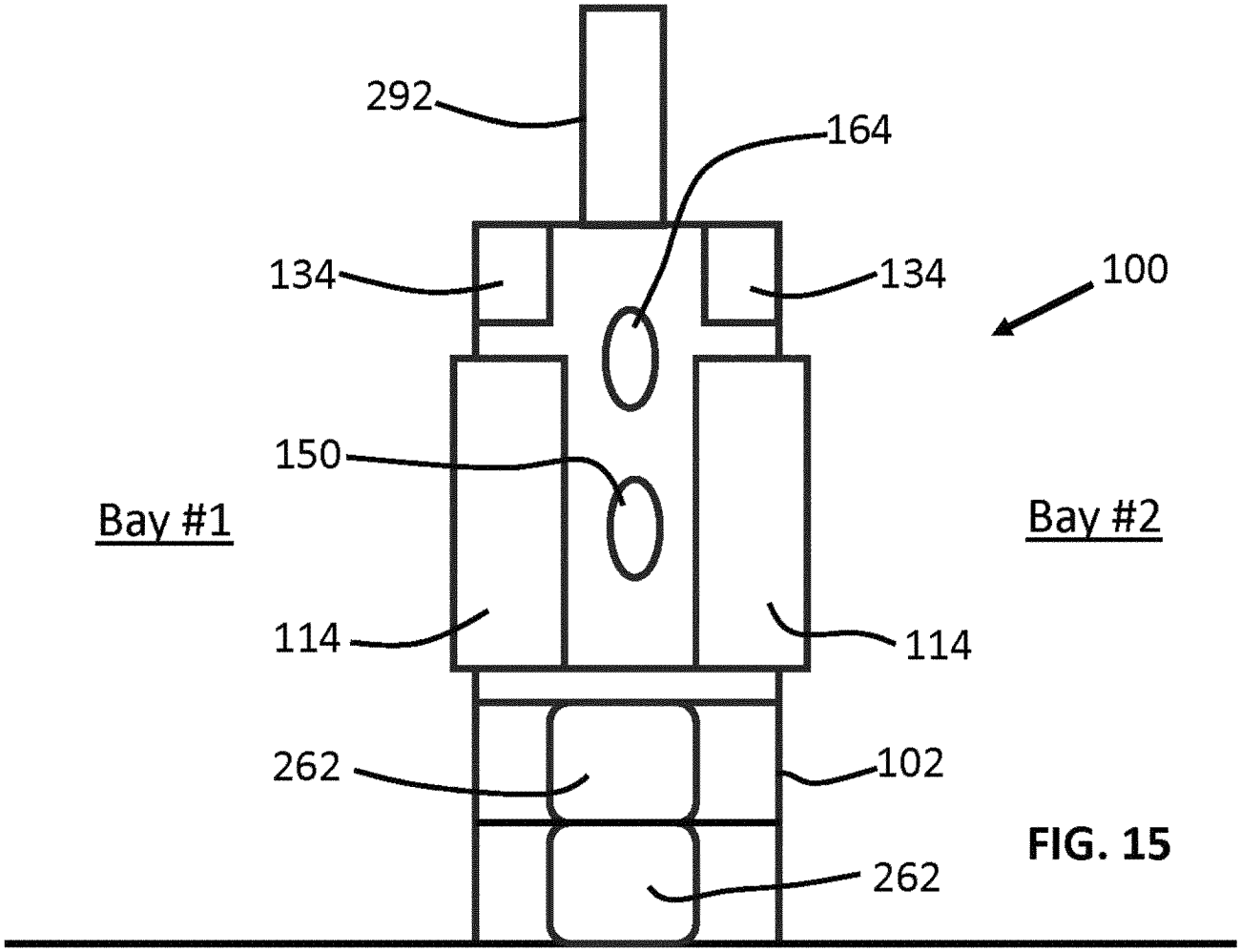
FIG. 15 is a schematic diagram showing an alternative oil change machine having at least two pumps.

FIG. 15 is a schematic diagram showing the alternative oil change assembly 100 of the present invention. As shown, the oil change assembly 100 has a housing 102 having two pumps 262 located therein with each pump operationally coupled to a respective service holding tank 114. Each pump 262 has components associated therewith for operating the pump, such as in the manner described above with reference to FIGS. 1-14. For example, each pump 262 has a control panel 134 with switches for changing the flow configuration of the multi-port valves to control the suction line 150 and the dispensing line 164 associated with the pump. A collector case 198 (FIGS. 4 and 5) can be provided with the housing or nearby, which can hold a plurality of draw hose assemblies 200. The housing can be secured to a structure 292, such as an I-beam, the floor, or a wall, and be without wheels, with wheels being optional.

The alternative oil change assembly 100 can be configured for use between two oil-change bays, Bay #1 and Bay #2, at an oil lube center to concurrently service two different vehicles using the two pumps 262 simultaneously. The alternative oil change assembly 100 with the two pumps 262 and two service holding tanks 114 can have similar operating components as discussed above for operating the oil change machine with a single pump and a single service holding tank. However, because each set of pump and service holding tank can operate without an offloading tank, the first multi-port valve and second multi-port valve for operating with the respective pump can be modified accordingly to bypass steps related to filling and draining an offloading tank.

Optionally, the two pumps 262 of the alternative oil change assembly or machine 100 can share a single service holding tank that has been partitioned into two separated reservoirs. Optionally, a single locally mounted offloading tank can be provided with the housing to receive used oil from the two service holding tanks.

Figure 16:
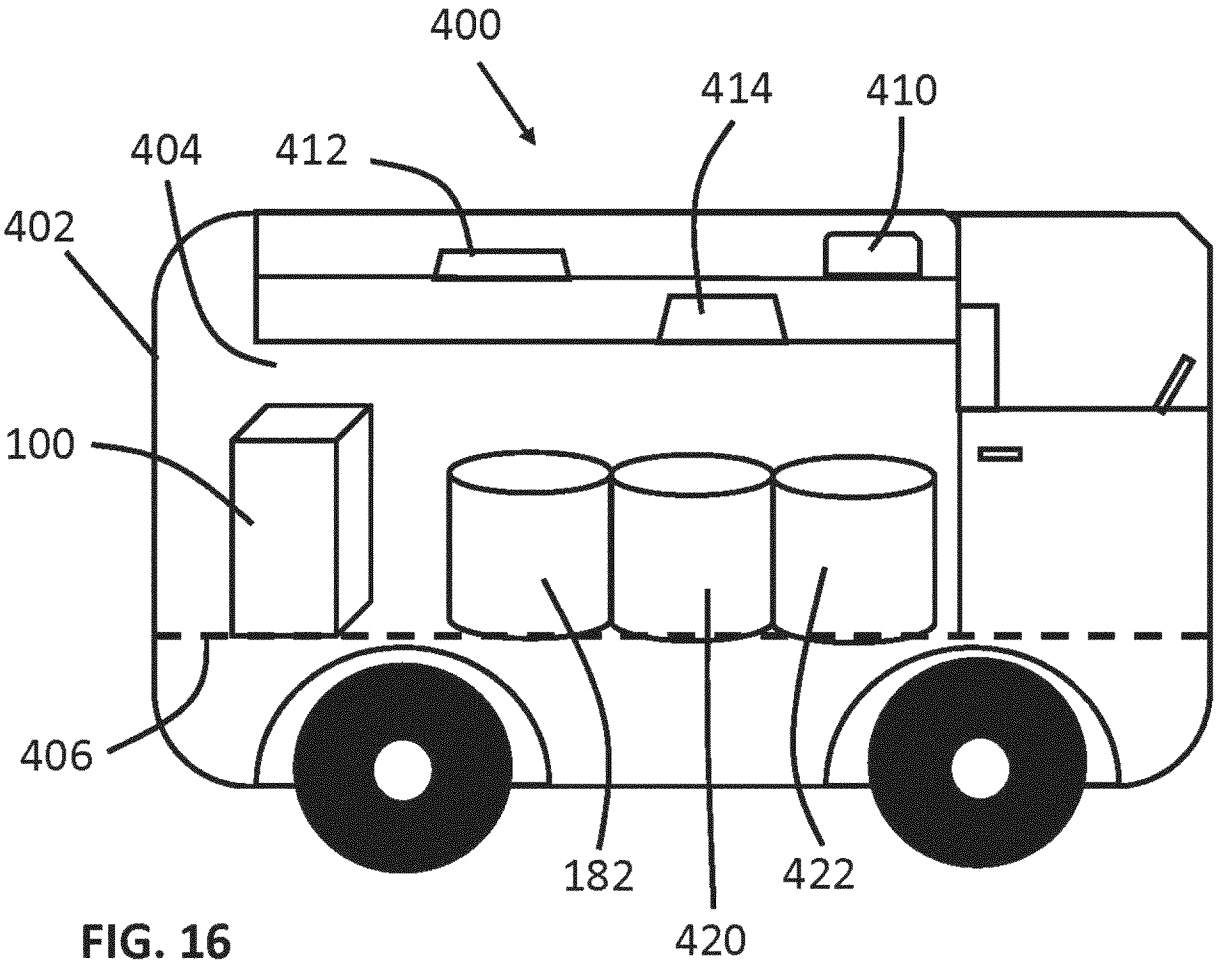
FIG. 16 is a schematic diagram showing a service truck or van having an oil change machine located thereon.

FIG. 16 is a schematic depiction of a mobile service vehicle 400 usable remotely from a service shop to change motor oil from vehicle engines, such as vehicles parked at a shopping center, a business complex, etc., as previously discussed. As shown, the mobile service vehicle 400 includes a service truck or van 402 having a storage space 404 and a floor 406. An oil change machine 100 as described elsewhere herein can be positioned on or in the service truck or van 402, which can be referred to generically as a service truck. The oil change machine 100 can include an onboard offloading tank as shown in FIGS. 1-14 for receiving used motor oil from the service holding tank. Alternatively or additionally, one or more separate offloading tanks 182 can be mounted in or on the service truck, outside of the oil change machine housing. The one or more separate offloading tanks 182 can receive used motor oil transferred from the service holding tank, which directly receives used oil suctioned from vehicle engines.

One or more fresh oil drums 420, 422 of different oil grades or types, such as 15 W-40, 10 W-30, and 5 W-30, can be located on or in the service truck 402. The fresh oil can be used to replace the used oil removed from the vehicle engines, of course after the engine oil has been removed using the oil change machine 100 located in or on the service truck 402. Different oil filters 410 and air filters 412 can also be carried in or on the service truck 402 to replace used oil and air filters removed from the vehicles that have been serviced. Instead of or in addition to fresh oil drums, fresh oil can be carried via separate oil containers or quarts 414.

The fresh oil drums, quarts, and new filters can represent the most common types and sizes used on a variety of vehicles. In some examples, service appointments can be made by vehicle owners so that the right filters and oil can be carried or loaded on the service truck 402 before the service truck arrives to the remote job site.

A method of making and of using an oil change machine and components thereof are within the scope of the present disclosure.

Although limited embodiments of the oil change machine and its components have been specifically described and illustrated herein, many modifications and variations will be apparent to those skilled in the art. For example, the various valves, pumps, switches, and materials are not limited to those exact models disclosed as equivalent and/or alternative means and suppliers can be used. Accordingly, it is to be understood that the oil change assembly and components constructed according to principles of the disclosed devices, systems, and methods may be embodied other than as specifically described herein. The disclosure is also defined in the following claims.

What is claimed:

1. An oil change machine comprising:

a housing having a body and an interior cavity;

a pump located within the interior cavity, said pump having a pump inlet and a pump discharge, the pump being operable using pressurized air or electrical power;

a first multi-port valve having a plurality of ports including an outlet port and at least two inlet ports, said outlet port in fluid communication with said pump inlet and said at least two inlet ports include a first inlet port and a second inlet port;

a first control switch on a control panel of the housing mechanically coupled to the first multi-port valve and configured to be manually actuated for changing flow directions through the at least two inlet ports;

a second multi-port valve having a plurality of ports including an inlet port and at least two outlet ports, which include a first outlet port and a second outlet port, said inlet port of said second multi-port valve is in fluid communication with the pump discharge;

a second control switch on the control panel of the housing mechanically coupled to the second multi-port valve and configured to be manually actuated for changing flow directions through the at least two outlet ports;

a suction line located upstream of the first multi-port valve and connected to the first multi-port valve, said suction line having a connection fitting sized and shaped to couple to a plurality of draw hose assemblies, one at a time, to suction used oil directly from an engine;

a first flow line connected to the first outlet port of the second multi-port valve and to a service holding tank having a first volumetric capacity;

a second flow line connected to the second outlet port of the second multi-port valve and to an offloading tank having a second volumetric capacity larger than the first volumetric capacity; and wherein the service holding tank is located on the housing or within the interior cavity of the housing and the service holding tank is at least partially viewable through an opening of the housing.

2. The oil change machine of claim 1, wherein the housing has an upper section that is movable relative to a lower section, and wherein the opening is located in the lower section.

3. The oil change machine of claim 1, further comprising two or more wheels for supporting and moving the housing.

4. The oil change machine of claim 1, further comprising a mesh filter located inline between the first multi-port valve and the pump inlet.

5. The oil change machine of claim 1, wherein the connection fitting is connected to a mating fitting of a first draw hose assembly that is sized and shaped to project into a dipstick tube of an engine and is disconnectable for connecting to a second draw hose assembly.

6. The oil change machine of claim 5, wherein the suction line further comprises a valve located downstream to the connection fitting.

7. The oil change assembly of claim 1, further comprising a collection case mounted to the housing, said collection case having an opening and wherein a plurality of draw hose assemblies of different hose line sizes are located in the opening of the collection case.

8. The oil change machine of claim 1, wherein the suction line is fluidly connected to the first inlet port of the first multi-port valve and the service holding tank is fluidly connected to the second inlet port of the first multi-port valve.

9. The oil change machine of claim 1, wherein used oil flowing into the suction line is directed to the service holding tank in a first operational position of the first control switch and the second control switch, and the used oil is directed from the service holding tank to the offloading tank in a second operational position of the first control switch and the second control switch.

10. The oil change machine of claim 1, wherein the service holding tank has a depth and wherein part of the depth is located within the housing and part of the depth is located external of the housing.

11. The oil change machine of claim 1, wherein a volume of used oil is first located in the service holding tank and then in the offloading tank.

12. The oil change machine of claim 1, wherein the control panel is located above the offloading tank and below a rotatable top housing section.

13. The oil change machine of claim 1, further comprising a 4-way cross-manifold located between the pump discharge and the second multi-port valve and in fluid communication with both the pump and the second multi-port valve.

14. The oil change machine of claim 13, further comprising a dispensing line connected to a port of the 4-way cross-manifold for dispensing used oil from the offloading tank.

15. An oil change machine comprising:

a housing having a main body section with an interior cavity and a top housing section pivotably connected to the main body section;

a control panel mounted to the main body section and exposed at a top section opening of the top housing section, said control panel having a first control switch and a second control switch mounted thereto;

a pump located within the interior cavity of the main body section, said pump having a pump inlet and a pump discharge;

a first multi-port valve mounted to the main body, said first multi-port valve having a plurality of ports including an outlet port and at least two inlet ports, which includes a first inlet port and a second inlet port, wherein a fluid line fluidly connects the outlet port to the pump inlet, wherein the first control switch is mechanically coupled to the first multi-port valve for changing flow directions through the at least two inlet ports;

a second multi-port valve mounted to the main body, said second multi-port valve comprising a port in fluid communication with the pump discharge;

a suction line located externally of the housing and connected to one of the two inlet ports of the first multi-port valve, wherein the suction line comprises a connection fitting;

a flow line connected to the first multi-port valve and to a service holding tank, said service holding tank having a first volumetric capacity for holding used oil suctioned through the suction line; and wherein at least part of the service holding tank is viewable through an opening formed through the main body section.

16. The oil change assembly of claim 15, further comprising a 4-way cross manifold having four ports in fluid communication with the pump discharge and wherein a dispensing line having a valve is connected to one of four ports of the 4-way cross manifold.

17. The oil change assembly of claim 16, further comprising a clamp at an end of the dispensing line.

18. The oil change machine of claim 15, further comprising a controller located in the housing, the controller is powered by 110V household power, 12V rechargeable lithium ion battery, 12V sealed lead acid battery, or an air turbine generator.

19. The oil change machine of claim 15, further comprising a mesh filter located inline with the fluid line.

20. An oil change machine comprising:

a pump having a pump inlet and a pump discharge;

a first multi-port valve having a plurality of ports including an outlet port and at least two inlet ports;

a first control switch mechanically coupled to the first multi-port valve for changing flow directions through the at least two inlet ports, wherein said outlet port of said first multi-port valve is in fluid communication with the pump inlet;

a second multi-port valve having a plurality of ports including an inlet port and at least two outlet ports;

a second control switch mechanically coupled to the second multi-port valve for changing flow directions through the at least two outlet ports, wherein said inlet port of said second multi-port valve is in fluid communication with the pump discharge;

a suction line located upstream of the first multi-port valve and in fluid communication with the first multi-port valve, said suction line is configured to suction used oil directly from an engine;

a flow line connected to the second multi-port valve and to a service holding tank;

a manifold having plurality of ports in fluid communication with the pump discharge and wherein a dispensing line having a valve is connected to one of the plurality of ports of the manifold; and a housing having a main body with an opening, wherein the pump and the service holding tank are located on or within the main body and the service holding tank is at least partially viewable through the opening.

21. The oil change machine of claim 20, wherein the first and second control switch are on a control panel of the housing.

22. The oil change machine of claim 20, wherein the service holding tank is in fluid communication with an offloading tank.

23. The oil change machine of claim 22, wherein the offloading tank is located within the main body of the housing.

* * * * *